US008474676B2

(12) United States Patent
Haramiishi et al.

(10) Patent No.: US 8,474,676 B2
(45) **Date of Patent: *Jul. 2, 2013**

(54) STAPLE REFILL, STAPLER, AND CARTRIDGE

(71) Applicant: Max Kabushiki Kaisha, Tokyo (JP)

(72) Inventors: Kiichi Haramiishi, Tokyo (JP); Nobuaki Yagi, Tokyo (JP); Katsunori Manabe, Tokyo (JP)

(73) Assignee: Max Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/688,778

(22) Filed: Nov. 29, 2012

(65) Prior Publication Data

US 2013/0087595 A1 Apr. 11, 2013

Related U.S. Application Data

(63) Continuation of application No. 13/486,086, filed on Jun. 1, 2012, now Pat. No. 8,360,292, which is a continuation of application No. 13/182,783, filed on Jul. 14, 2011, now Pat. No. 8,418,903, which is a continuation of application No. 12/759,109, filed on Apr. 13, 2010, now Pat. No. 8,033,437, which is a continuation of application No. 10/544,848, filed as application No. PCT/JP2004/001273 on Feb. 6, 2004, now Pat. No. 7,748,587.

(30) Foreign Application Priority Data

Feb. 7, 2003 (JP) ..... 2003-031688
Jun. 30, 2003 (JP) ..... 2003-188643

(51) Int. Cl.
*B25C 5/16* (2006.01)

(52) U.S. Cl.
USPC ..... 227/120; 227/131; 227/156

(58) Field of Classification Search
USPC ..... 227/4, 120, 131, 129, 156, 82; 206/338, 206/340
See application file for complete search history.

(56) References Cited

U.S. PATENT DOCUMENTS 2,943,436 A 7/1960 Peterssen
4,978,045 A 12/1990 Murakami et al.

(Continued)

FOREIGN PATENT DOCUMENTS

JP 4-97670 8/1992
JP 4-304977 10/1992

(Continued)

OTHER PUBLICATIONS

U.S. Appl. No. 13/486,204, filed Jun. 1, 2012, Haramiishi.

(Continued)

*Primary Examiner* — M. Alexandra Elve
*Assistant Examiner* — Nathaniel Chukwurah
(74) *Attorney, Agent, or Firm* — Drinker Biddle & Reath LLP

(57) ABSTRACT

A staple refill including a refill body accommodating sheet-type connected staples. The refill body includes a bottom wall, a right wall provided on a right side of the bottom wall and formed with a vertically extending right guide slot, and a left wall provided on a left side of the bottom wall and formed with a vertically extending left guide slot. A pressing member is provided in the refill body in a movable manner to press the sheet-type connected staples. The pressing member includes a guide shaft guided along the right and left guide slots. The guide shaft includes a right end portion protruding outside the right wall through the right guide slot, and a left end portion protruding outside the left wall through the left guide slot.

9 Claims, 22 Drawing Sheets

U.S. PATENT DOCUMENTS

| | | | | |
|---|---|---|---|---|
| 5,501,387 | A | 3/1996 | Yoshie | |
| 6,039,230 | A | 3/2000 | Yagi et al. | |
| 6,216,936 | B1 | 4/2001 | Abe | |
| 6,557,744 | B2 | 5/2003 | Kitamura | |
| 6,616,027 | B2 | 9/2003 | Mochizuki | |
| 6,705,504 | B1 * | 3/2004 | Kanai et al. | 227/135 |
| 6,736,304 | B2 * | 5/2004 | Mochizuki | 227/131 |
| 6,899,258 | B2 * | 5/2005 | Haramiishi | 227/2 |
| D512,289 | S | 12/2005 | Miwa et al. | |
| D512,889 | S | 12/2005 | Miwa et al. | |
| 7,748,587 | B2 | 7/2010 | Haramiishi et al. | |
| 8,360,292 | B2 * | 1/2013 | Haramiishi et al. | 227/120 |
| 2003/0111504 | A1 * | 6/2003 | Kanai et al. | 227/2 |
| 2004/0232192 | A1 | 11/2004 | Marks | |
| 2004/0245307 | A1 | 12/2004 | Haramiishi | |

FOREIGN PATENT DOCUMENTS

| | | | |
|---|---|---|---|
| JP | 4-18776 | | 2/1994 |
| JP | 6-210579 | A | 8/1994 |
| JP | 2689840 | B2 | 8/1994 |
| JP | 7-18538 | | 5/1995 |
| JP | 7-185539 | | 5/1995 |
| JP | 8-71951 | | 3/1996 |
| JP | 08-127461 | | 5/1996 |
| JP | 11-254347 | | 9/1999 |
| JP | 2000-153472 | | 6/2000 |
| JP | 2001-105345 | | 4/2001 |
| JP | 2001-245595 | A | 9/2001 |
| JP | 2002-200575 | | 7/2002 |
| JP | 2003-053680 | A | 2/2003 |

OTHER PUBLICATIONS

U.S. Appl. No. 13/486,365, filed Jun. 1, 2012, Haramiishi.

U.S. Office Action dated Oct. 12, 2012 that issued in U.S. Appl. No. 13/486,204.

U.S. Office Action dated Sep. 27, 2012 that issued in U.S. Appl. No. 13/486,365.

Microfilm of the specification and drawings annexed to the request of Japanese Utility Model Appln. No. 10491/1985 (Laid-Open No. 15474/1987) (Max Co., Ltd.), Jan. 29, 1987.

Notification of Reasons for Rejection, dated May 28, 2007, issued by the Japanese Patent Office in Japanese Appln. No. 2005-504898, with English-language translation.

Notification of Reasons for Rejection, dated May 28, 2007, issued by the Japanese Patent Office in Japanese Appln. No. 2004-137820, with English-language translation.

Notification of Reasons for Rejection, dated May 28, 2007, issued by the Japanese Patent Office in Japanese Appln. No. 2004-137818, with English-language translation.

* cited by examiner (a)

(b)

(a)

(b)

(c)

1
2
5
5a
9
41
44a
44b
45a
46a
46b
47a
66
70
S
X
Y
A
B (a)

(b)

STAPLE REFILL, STAPLER, AND CARTRIDGE

CROSS-REFERENCE TO RELATED APPLICATIONS

This application is a continuation of U.S. application Ser. No. 13/486,086 filed on Jun. 1, 2012, which is a continuation of U.S. application Ser. No. 13/182,783 filed on Jul. 14, 2011, which is a continuation of U.S. application Ser. No. 12/759,109 filed on Apr. 13, 2010 now U.S. Pat. No. 8,033,437, which is a continuation of U.S. application Ser. No. 10/544,848 filed on Aug. 8, 2005 now U.S. Pat. No. 7,748,587, which is a national stage application of International Application No. PCT/JP2004/001273 filed on Feb. 6, 2004, which claims priority to Japanese Application Nos. 2003-031688 filed on Feb. 7, 2003 and 2003-188643 filed on Jun. 30, 2003, the entire contents of each of these being incorporated herein by reference.

TECHNICAL FIELD

The present invention relates to a refill (refill case) in which a plurality of sheet-type connected staples (staple sheets) are laminated and held, a cartridge for staple sheets in which the refill (refill case) is held in a detachable manner, and a stapler mounting the refill (refill case).

BACKGROUND ART

A conventional cartridge which holds sheet-type connected staples has been configured to be installed through a fixing link in a magazine of a stapler body in a detachable manner (for example, a patent document 1). Moreover, a conventional cartridge which holds sheet-type connected staples has been provided with a delivery port through which sheet-type connected staples are delivered in the forward and downward direction (for example, the patent document 1). Furthermore, a conventional refill which holds sheet-type connected staples has comprised a staple sheet holder which holds sheet-type connected staples, and a binding band by which sheet-type connected staples and a staple sheet holder are integrated into one piece in a direction in which sheet-type connected staples are sent out, that is, in a direction substantially perpendicular to that of a staple needle (for example, a patent document 4).

Moreover, a conventional cartridge which holds sheet-type connected staples has delivered a laminated sheet-type connected staple at the lowest layer from a delivery port one by one, using a sending pawl mechanism in a stapler body (for example, a patent document 3). Moreover, in a cartridge which holds sheet-type connected staples, the sheet-type connected staples have been pressed by a pressing member which is energized with an elastic member such as a spring provided in a cartridge body (for example, a patent document 2, and the patent documents 1 and 3).

Moreover, electric staplers generally have a configuration in which a number of staples can be discharged, using a motor as a driving source. Among the general electric staplers, there have been known a type of staplers with a configuration in which a cartridge in which a plurality of staple sheets are laminated and held is mounted in a stapler body, and the staple sheets are sequentially sent out from the cartridge to a stapling section and the sent-out staple sheets are sequentially bent into U-shaped ones from a top staple among staples for discharging during stapling operation.

The electric staplers of this type have a sending pawl, and a sending roller as a sending unit by which first a staple sheet at the lowest layer or the uppermost layer is delivered to the outside of the cartridge one by one, and staple sheets are delivered from a delivery port of the cartridge by engaging the sending unit with the upper surface or the lower surface of the above-described staple sheets for moving.

Incidentally, frictional force, which is generated when the upper surface or the lower surface of the staple sheets is engaged with the sending unit, is required to be increased in order to securely deliver staple sheets in the cartridge. Accordingly, an ordinary cartridge for staple sheets has a configuration (for example, refer to a patent document 5) in which the whole staple sheet can be pressed from the opposite side of a sending unit thereto with a spring provided in the cartridge to strongly engage the sending unit with the surface of a staple sheet.

Moreover, a cartridge recently has a configuration in which staple sheets are laminated and held in a refill case, and a refill case can be detached from a cartridge, and the refill case is exchanged as a whole when there is no staple sheets in the refill case. Though an energizing unit such as a spring is required for staple sheets in the above-described refill case, the energizing unit has been provided in the refill case.

Patent Document 1: Japanese Laid-Open Utility Patent Publication No. H4 (1992)-18776;

Patent Document 2: Japanese Laid-Open Utility Patent Publication No. H7 (1995)-18538;

Patent Document 3: Japanese Laid-Open Patent Application Publication No. 2001-245595;

Patent Document 4: Japanese Patent Publication No. 2689840; and

Patent Document 5: Japanese Laid-Open Patent Application Publication No. H8 (1996)-127461.

[First Problem]

A conventional cartridge that holds sheet-type connected staples is installed in a magazine of a stapler body through a fixing link in a detachable manner, and can be removed from the magazine in a state in which a sheet-type connected staple is sticking out from the delivery port of the cartridge in partway. But, in such a case, there has been a problem that a sheet-type connected staple is broken to cause a trouble such as clogging. Moreover, a conventional cartridge holding sheet-type connected staples has a configuration in which a delivery port is open at any time, and has had a problem that a sheet-type connected staple emits from the delivery port. Moreover, in a refill having a binding band, the binding band prevents a sheet-type connected staple from emitting from a staple sheet holder. But, there has bee a problem that an inconvenience is caused because the binding band is required to be removed in order to send out the sheet-type connected staples with the binding band after the refill is mounted in the cartridge. Moreover, both hands are required to be used for removing the binding band. Accordingly, there has been a problem that the removing can not be realized with one hand.

Furthermore, a conventional cartridge holding sheet-type connected staples has had a configuration in which laminated sheet-type-connected-staples at the lowest layer are delivered one by one from a delivery port with a sending pawl mechanism in a stapler body, and has had a problem that a sheet-type connected staple pulled out is pulled back to cause a trouble such as idle stapling when the sending pawl is returned. In addition, a conventional cartridge holding sheet-type connected staples has had a configuration in which sheet-type connected staples are pressed with a pressing member energized with an elastic member such as a spring provided in a cartridge body and has had a problem in the weight and the cost. Moreover, a cartridge body formed of a soft synthetic-resin material, and an elastic member such as a spring formed of a metallic material are formed of different materials from each other in a conventional cartridge holding sheet-type connected staples, and separate decomposition for each material is required for discarding. Accordingly, there has been a problem that discarding is troublesome. Here, the above-described conventional cartridge is corresponding to the refill in the present invention, and the above-described magazine is corresponding to the cartridge in the present invention.

The present invention has been made, considering the above-described problems, and a first object is to provide a refill for staples which can not be removed from a cartridge unless all sheet-type connected staples in a stapler body are delivered. Moreover, a second object is to provide a refill for staples in which a delivery port is closed at storing and carrying, and the delivery port is opened when the refill for staples is mounted in a cartridge.

Furthermore, a third object is to provide a refill for staples in which sheet-type connected staples can be sent to a delivery port without backward movement. In addition, a fourth object is to provide a refill for staples in which reduction of the main body in the weight and the cost can be realized, based on a configuration in which an elastic member such as a spring formed of a metallic material is not to be required, and separate decomposition for each material is not required for discarding to cause simple discarding. Moreover, a fifth object is to provide a refill for staples in which reduction of the refill in the weight and the cost can be realized, based on a configuration in which there is provided an energizing unit which energizes in the pressing direction a pressing member for a refill holding sheet-type connected staples, and an elastic member is not required in a refill body.

[Second Problem]

Moreover, cartridges and refill cases, which have been used, are discarded. Accordingly, components provided with an energizing unit such as a spring in a refill case have been also discarded to cause adverse effects on environment protection and recycling.

An object of the present invention is to provide a cartridge for staple sheets in which an energizing unit can be repeatedly used, and handling is easy.

DISCLOSURE OF THE INVENTION

In order to solve the above-described problems, a first aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein a delivery port delivering the sheet-type connected staples is formed in the refill body, and, at the same time, a locking plate is provided at a side opposite to the delivery port, a locking section which locks a locked section formed in the stapler body or the cartridge is provided in the locking plate, and the pressing member is engaged with the locking plate while the sheet-type connected staples are pressed, and, while the sheet-type connected staples are not pressed, the pressing member is disengaged from the locking plate to allow movement of the locking plate in the unlocking direction, and the locking section on the locking plate can get out of the locked section in the stapler body or the cartridge.

Moreover, a second aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein a delivery port delivering the sheet-type connected staples is formed in the refill body, and, at the same time, a locking plate is provided at a side opposite to the delivery port, a locking section which locks a locked section formed in the stapler body or the cartridge is provided in the locking plate, the locking plate is prevented with the sheet-type connected staples held in the refill body from moving in the unlocking direction, and the pressing member is engaged with the locking plate while the sheet-type connected staples are pressed, and, while the sheet-type connected staples are not pressed, the pressing member is disengaged from the locking plate to allow movement of the locking plate in the unlocking direction, and the locking section on the locking plate can get out of the locked section in the stapler body or the cartridge.

Moreover, a third aspect of the present invention has the following configuration. That is, the invention is the refill for staples according to the first or second aspect of the invention, wherein the refill body comprises: a bottom wall; a front wall provided in the front portion of the bottom wall; a right wall provided in the right portion of the bottom wall; a left wall provided in the left portion of the bottom wall; and the locking plate rotatably provided in the rear portion of the bottom wall, the delivery port is formed in the lower portion of the front wall, a guide projection resting on the front wall is formed in the front portion of the pressing member, the guide projection rests on the front wall and the rear portion of the projection is engaged with the locking plate while the sheet-type connected staples are pressed, and, while the sheet-type connected staples are not pressed, the projection gets out of the front wall and the rear portion of the projection is disengaged from the locking plate to allow rotation of the locking plate in the unlocking direction.

Moreover, a fourth aspect of the present invention has the following configuration. That is, the invention is the refill for staples according to the first or second aspect of the invention, wherein the refill body comprises: a bottom wall; a front wall provided in the front portion of the bottom wall; a right wall provided in the right portion of the bottom wall; a left wall provided in the left portion of the bottom wall; and the locking plate rotatably provided in the rear portion of the bottom wall, the delivery port is formed in the lower portion of the front wall, a guide slot extending in the vertical direction is provided on each of the right and left walls, and, at the same time, a concave portion is formed toward the front in the lower portion of each guide slot, the pressing member has a guide shaft guided in the guide slot, while the sheet-type connected staples are pressed, the guide shaft is guided in the guide slot, and the rear portion of the guide shaft is engaged with the locking plate, while the sheet-type connected staples are not pressed, the guide shaft gets out of the guide slot and enters into the concave portion to disengage the rear portion of the pressing member and the locking plate, and the locking plate can be rotated in the unlocking direction.

Moreover, a fifth aspect of the present invention has the following configuration. That is, the invention is a refill for staples which is installed in a detachable manner in a stapler body, or in a cartridge provided for the stapler body, comprising: a refill body holding sheet-type connected staples; and a pressing member which presses the sheet-type connected staples, wherein the refill body comprises: a bottom wall; a front wall provided in the front portion of the bottom wall; a right wall provided in the right portion of the bottom wall; a left wall provided in the left portion of the bottom wall; and a locking plate provided in the rear portion of the bottom wall, a locking section locking a locked section formed in the stapler body or the cartridge is provided on the locking plate, the pressing member is movably provided in the refill body in a state in which the front portion of the pressing member rests on the front wall, and the rear portion of the pressing member is engaged with the locking plate, and a delivery port, which delivers the sheet-type connected staples, and, by which the front portion of the pressing member resting on the bottom wall gets out of the front wall to allow forward movement of the pressing member, is formed in the lower portion of the front wall.

Moreover, a sixth aspect of the present invention has the following configuration. That is, the invention is a refill for staples which is installed in a detachable manner in a stapler body, or in a cartridge provided for the stapler body, comprising: a refill body holding sheet-type connected staples; and a pressing member which presses the sheet-type connected staples, wherein the refill body comprises: a bottom wall; a front wall provided in the front portion of the bottom wall; a right wall provided in the right portion of the bottom wall; a left wall provided in the left portion of the bottom wall; and a locking plate provided in the rear portion of the bottom wall, a locking section locking a locked section formed in the stapler body or the cartridge is provided on the locking plate, a delivery port is formed in the lower portion of the front wall, a guide slot extending in the vertical direction is provided on each of the right and left walls, the pressing member has a guide shaft guided in the guide slot, and the pressing member is movably provided in the refill body in a state in which the rear portion of the pressing member is engaged with the locking plate while the guide shaft is guided in the guide slot, and a concave portion is formed in the lower portion of the guide slot so that the guide shaft of the pressing member resting on the bottom wall gets out of the guide slot to allow forward movement of the pressing member.

Moreover, a seventh aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein a delivery port delivering the sheet-type connected staples is formed in the refill body, and, at the same time, a locking plate is provided at a side opposite to the delivery port, a locking section locking a locked section formed in the stapler body or the cartridge is provided on the locking plate, while the sheet-type connected staples are pressed, the pressing member is engaged with the locking plate not to allow movement of the locking plate in the unlocking direction, and the locking section on the locking plate is preventing from getting out of the locked section in the stapler body or the cartridge, and while the sheet-type connected staples are not pressed, the pressing member is disengaged from the locking plate to allow movement of the locking plate in the unlocking direction, and the locking section on the locking plate can get out of the locked section in the stapler body or the cartridge.

Moreover, a eighth aspect of the present invention has the following configuration. That is, the invention is the refill for staples according to the seventh aspect of the invention, wherein the refill body comprises: a bottom wall; a front wall provided in the front portion of the bottom wall; a right wall provided in the right portion of the bottom wall; a left wall provided in the left portion of the bottom wall; and the locking plate rotatably provided in the rear portion of the bottom wall, the delivery port is formed in the lower portion of the front wall, a guide projection resting on the front wall is formed in the front portion of the pressing member, while the sheet-type connected staples are pressed, the guide projection rests on the front wall, and the rear portion of the projection is engaged with the locking plate not to allow rotation of the locking plate in the unlocking direction, and while the sheet-type connected staples are not pressed, the guide projection gets out of the front wall and the rear portion of the projection is disengaged from the locking plate to allow rotation of the locking plate in the unlocking direction.

Moreover, a ninth aspect of the present invention has the following configuration. That is, the invention is the refill for staples according to the seventh aspect of the invention, wherein the refill body comprises: a bottom wall; a front wall provided in the front portion of the bottom wall; a right wall provided in the right portion of the bottom wall; a left wall provided in the left portion of the bottom wall; and the locking plate rotatably provided in the rear portion of the bottom wall, the delivery port is formed in the lower portion of the front wall, a guide slot extending in the vertical direction is provided on each of the right and left walls, and, at the same time, a concave portion is formed toward the front in the lower portion of each guide slot, the pressing member has a guide shaft guided in the guide slot, while the sheet-type connected staples are pressed, the guide shaft is guided in the guide slot, and the rear portion of the guide shaft is engaged with the locking plate not to allow rotation of the locking plate in the unlocking direction, and while the sheet-type connected staples are not pressed, the guide shaft gets out of the guide slot and enters into the concave portion to disengage the rear portion of the pressing member and the locking plate, and the locking plate can be rotated in the unlocking direction.

Moreover, a 10th aspect of the present invention has the following configuration. That is, the invention is a refill for staples which is installed in a detachable manner in a stapler body, or in a cartridge provided for the stapler body, comprising: a refill body holding sheet-type connected staples, wherein a delivery port delivering the sheet-type connected staples and a covering member closing the delivery port are provided in the refill body, and the covering member opens the delivery port by engagement with the stapler body or one side of the cartridge when the refill body is mounted in the stapler body or the cartridge.

Moreover, a 11th aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein a delivery port delivering the sheet-type connected staples and a covering member closing the delivery port are provided in the refill body, and the covering member opens the delivery port by engagement with the stapler body or one side of the cartridge when the refill body is mounted in the stapler body or the cartridge.

Moreover, a 12th aspect of the present invention has the following configuration. That is, the invention is a refill for staples which is installed in a detachable manner in a stapler body, or in a cartridge provided for the stapler body, comprising a refill body holding sheet-type connected staples, wherein a delivery port delivering the sheet-type connected staples is formed in the refill body, and, a projection for backward-motion prevention, which prevents the sheet-type connected staples from moving to a direction opposite to the delivery port, is formed in the refill body.

Moreover, a 13th aspect of the present invention has the following configuration. That is, the invention is a refill for staples which is installed in a detachable manner in a stapler body, or in a cartridge provided for the stapler body, comprising a refill body holding sheet-type connected staples, wherein a delivery port delivering the sheet-type connected staples is formed in the refill body, and, a projection for backward-motion prevention, which prevents the sheet-type connected staples from moving to a direction opposite to the delivery port, is formed in a bottom wall.

Moreover, a 14th aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein a delivery port delivering the sheet-type connected staples is formed in the refill body, and a projection for backward-motion prevention, which prevents the sheet-type connected staples from moving to a direction opposite to the delivery port, is formed in the pressing member.

Moreover, a 15th aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein a delivery port delivering the sheet-type connected staples is formed in the refill body, and a projection for backward-motion prevention, which prevents the sheet-type connected staples from moving to a direction opposite to the delivery port, is formed in a bottom wall and in the pressing member.

Moreover, a 16th aspect of the present invention has the following configuration. That is, the invention is the refill for staples according to the 15th aspect of the invention, wherein the projections for backward-motion prevention on the pressing member are formed out of phase with the projections for backward-motion prevention on the bottom wall.

Moreover, a 17th aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein the refill body comprises: a bottom wall; a front wall provided in the front portion of the bottom wall; a right wall provided in the right portion of the bottom wall; and a left wall provided in the left portion of the bottom wall, a delivery port delivering the sheet-type connected staples is formed in the front wall, a guide slot extending in the vertical direction is provided on each of the right and left walls, the pressing member has a guide shaft guided in the guide slot, the guide shaft is engaged with energizing units provided in the stapler body when the refill body is mounted in the stapler body, or when the refill body is installed in the cartridge, and is mounted in the stapler body, and the pressing member is energized in the pressing direction with the energizing units.

Moreover, a 18th aspect of the present invention has the following configuration. That is, the invention is a refill for staples which is installed in a detachable manner in a stapler body, or in a cartridge provided for the stapler body, comprising: a refill body holding sheet-type connected staples; and a pressing member which is movably provided in the refill body, and presses the sheet-type connected staples, wherein the refill body comprises: a bottom wall; a front wall provided in the front portion of the bottom wall; a right wall provided in the right portion of the bottom wall; and a left wall provided in the left portion of the bottom wall, a delivery port delivering the sheet-type connected staples is formed in the front wall, and the pressing member is energized in the pressing direction with energizing units provided in the stapler body when the refill body is mounted in the stapler body, or when the refill body is installed in the cartridge, and is mounted in the stapler body.

Moreover, a 19th aspect of the present invention has the following configuration. That is, the invention is a refill for staples which is installed in a detachable manner in a cartridge provided for a stapler body, comprising: a refill body holding sheet-type connected staples; and a pressing member which is movably provided in the refill body, and presses the sheet-type connected staples, wherein the refill body comprises: a bottom wall; a front wall provided in the front portion of the bottom wall; a right wall provided in the right portion of the bottom wall; and a left wall provided in the left portion of the bottom wall, a delivery port delivering the sheet-type connected staples is formed in the front wall, and the pressing member is energized in the pressing direction with energizing units provided in the cartridge when the refill body is mounted in the cartridge.

Moreover, a 20th aspect of the present invention has the following configuration. That is, the invention is a refill for staples which is installed in a detachable manner in a cartridge provided for the stapler body, comprising: a refill body holding sheet-type connected staples; and a pressing member which is movably provided in the refill body, and presses the sheet-type connected staples, wherein the refill body comprises: a bottom wall; a front wall provided in the front portion of the bottom wall; a right wall provided in the right portion of the bottom wall; and a left wall provided in the left portion of the bottom wall, a delivery port delivering the sheet-type connected staples is formed in the front wall, a guide slot extending in the vertical direction is provided on each of the right and left walls, the pressing member has a guide shaft guided in the guide slot, the guide shaft is engaged with energizing units provided in the cartridge when the refill body is mounted in the cartridge, and the pressing member is energized in the pressing direction with the energizing units.

Moreover, a 21st aspect of the present invention has the following configuration. That is, the invention is a stapler provided with a cartridge which can install in a detachable manner a refill for staples holding sheet-type connected staples, and, at the same time, provided with a pressing member pressing the sheet-type connected staples, wherein the cartridge is provided in a stapler body in such a way that the cartridge can be pulled out from the body, and energizing units, by which the pressing member in the refill for staples installed in the cartridge is energized in the pressing direction at about the same time the cartridge is pushed into the stapler body, and by which the pressing member in the refill for staples installed in the cartridge is stopped from being energized in the pressing direction when the cartridge is pulled out from the stapler body, are provided in the stapler body.

Moreover, a 22nd aspect of the present invention has the following configuration. That is, the invention is the stapler according to the 21st aspect of the invention, wherein the cartridge is provided in the stapler body in a detachable manner.

Moreover, a 23rd aspect of the present invention has the following configuration. That is, the invention is the stapler according to the 21st or 22nd aspect of the invention, wherein the energizing unit comprises an arm member, and an elastic member energizing the arm member, and the arm member energizes the guide shaft of the pressing member guided in the guide slots formed on both sides of the refill body.

Moreover, a 24th aspect of the present invention has the following configuration. That is, the invention is a cartridge which can install in a detachable manner a refill for staples holding sheet-type connected staples, and, at the same time, provided with a pressing member pressing the sheet-type connected staples, wherein an energizing unit, by which the pressing member of the refill for staples is energized in the pressing direction when the refill for staples is installed in the cartridge, is provided in the cartridge.

Moreover, a 25th aspect of the present invention has the following configuration. That is, the invention is a cartridge for staple sheets, comprising: a cartridge body provided with a holding section which holds in a detachable manner a refill case in which a plurality of staple sheets are laminated and held; and a refill holder which is rotatably provided in the cartridge body, wherein the refill case held in the holding section is held and fixed by the rotatable refill holder, and, at the same time, the refill holder is provided with a pressing unit which presses the staple sheets in the direction orthogonal to the surface of the staple sheets when the refill holder is rotated.

Moreover, a 26th aspect of the present invention has the following configuration. That is, the invention is a refill for staples which is mounted in a stapler body or a cartridge mounted in the stapler body in a detachable manner, comprising a refill body, a pressing member provided in the refill body, and a locking unit, wherein the refill body comprises an accommodation section accommodating sheet-type connected staples, a delivery port delivering the sheet-type connected staples, a resting section which limits movement of the pressing member by resting on a part of the pressing member while the pressing member is lowered in the refill body, and which allows movement of the pressing member by stopping of resting on the pressing member when the resting section is lowered to the lowest position, and an opening through which a unit for sending the sheet-type connected staples, which is provided in the stapler body, is engaged with the sheet-type connected staples, the pressing member comprises an engaged unit which is engaged with an energizing unit provided in the stapler body, and a pressing section which rests on the sheet-type connected staples accommodated in the refill body, and presses the sheet-type connected staples with energizing force caused by the energizing unit, the locking unit, which is movably installed in the refill body, comprises a locking section which is engaged in a detachable manner with an engaged section provided in the stapler body or in the cartridge, which is mounted in a detachable manner in the stapler body, operation, such as rotation, of the locking unit is limited by engagement with the pressing member for which movement in the refill body is limited, or the sheet-type connected staples, and the limited operation is released by movement of the pressing member which is allowed to move, or by consumption of the sheet-type connected staples.

Moreover, a 27th aspect of the present invention has the following configuration. That is, the invention is a refill for staples which is mounted in a stapler body or a cartridge mounted in the stapler body in a detachable manner, comprising an accommodation section accommodating sheet-type connected staples, a delivery port delivering the sheet-type connected staples, and a delivery control unit controlling delivery of the sheet-type connected staples by resting on the tip of the sheet-type connected staples delivered from the delivery port, wherein a resting unit, which releases control of the sheet-type connected staples by resting on an engaged section provided in the stapler body or in the cartridge mounted in a detachable manner in the stapler body, is provided in the delivery control unit.

EMBODIMENTS OF THE INVENTION

Figure 1:
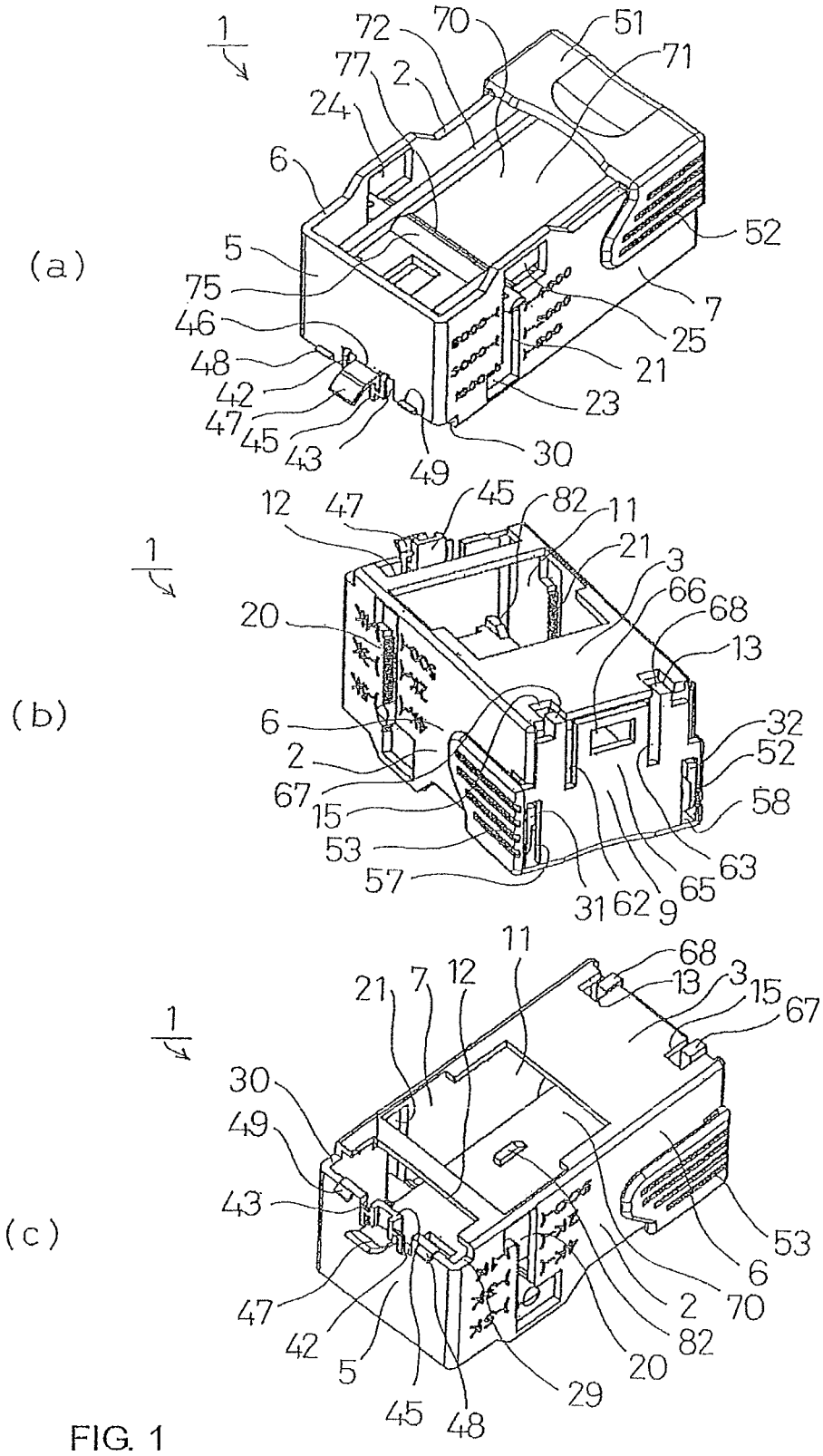
FIG. 1(A) is a general perspective view showing a refill for staples according to an embodiment of the present invention.
FIG. 1(B) is a general perspective view showing the refill for staples according to the embodiment of the present invention.
FIG. 1(C) is a general perspective view showing the refill for staples according to the embodiment of the present invention.

The refill for staples according to an embodiment of the present invention has a configuration in which mounting and dismounting of the refill for staples in the stapler body or the cartridge can be easily performed only with a single hand; when the pressing member presses the sheet-type connected staples, that is, when there is remained the sheet-type connected staples in the refill body, the pressing member is engaged with the locking plate; when the pressing member does not press the sheet-type connected staple, that is, when all sheet-type connected staples in the refill body are delivered and there is no sheet-type connected staples, the pressing member is disengaged from the locking plate, movement of the locking plate can be allowed in the unlocking direction; and the locking section of the locking plate can be removed from the locked section in the stapler body or in the cartridge. That is, the refill for staples has an advantage that, as the refill for staples can not be removed from the stapler body or the cartridge unless all sheet-type connected staples are delivered from the refill body, the sheet-type connected staples can be prevented from breaking; thereby, a trouble such as clogging caused by the breaking can be eliminated.

Moreover, the refill for staples has a configuration in which, when the pressing member presses the sheet-type connected staples, that is, when there is remained the sheet-type connected staples in the refill body, the guide projection of the pressing member rests on the front wall, the rear portion of the pressing member is engaged with the locking plate; and, when the pressing member does not press the sheet-type connected staple, that is, when all sheet-type connected staples in the refill body are delivered and there is no staples, the guide projection of the pressing member gets out of the front wall to allow movement of the pressing member in the unlocking direction, the rear portion of the pressing member is disengaged from the locking plate to allow rotation of the locking plate in the unlocking direction, and the locking section on the locking plate can be removed from the locked section in the stapler body or the cartridge. Accordingly, the refill for staples has an advantage that, as the refill for staples can not be removed from the stapler body or the cartridge unless all sheet-type connected staples are delivered from the refill body, the sheet-type connected staples can be prevented from breaking; thereby, a trouble such as clogging caused by the breaking can be eliminated.

Moreover, the refill for staples has a configuration in which, when the pressing member presses the sheet-type connected staples, that is, when there is remained the sheet-type connected staples in the refill body, the guide shaft in the pressing member is guided in the guide slots provided in the right and left walls, and the rear portion of the pressing member is engaged with the locking plate; and, when the pressing member does not press the sheet-type connected staple, that is, when all sheet-type connected staples in the refill body are delivered and there is no sheet-type connected staples, the guide shaft of the pressing member gets out of the guide slots and enters into the concave portion to allow movement of the pressing member in the unlocking direction, the rear portion of the pressing member is disengaged from the locking plate to allow rotation of the locking plate in the unlocking direction, and the locking section on the locking plate can be removed from the locked section in the stapler body or the cartridge. Accordingly, the refill for staples has an advantage that, as the refill for staples can not be removed from the stapler body or the cartridge unless all sheet-type connected staples are delivered from the refill body, the sheet-type connected staples can be prevented from breaking; thereby, a trouble such as clogging caused by the breaking can be eliminated.

Moreover, the refill for staples has an advantage that, as the delivery port which is provided in the refill body and delivers the sheet-type connected staples is closed with the covering member, a binding band by which the refill body and the sheet-type connected staples are integrated into one piece for binding is not required, and the sheet-type staples is prevented even at storing and carrying from emitting from the delivery port.

Moreover, the refill for staples has an advantage that, as the covering member opens the delivery port by engagement with the stapler body or one side of the cartridge when the refill body is mounted in the stapler body or the cartridge, mounting of the refill for staples in the stapler body or the cartridge can be easily performed only with a single hand because the covering member is not required to be removed before the stapler body or the cartridge is mounted, and the binding band is not required to be removed after mounting the stapler body or the cartridge, different from a conventional manner.

Moreover, the refill for staples has an advantage that, as the delivery port which delivers sheet-type connected staples is formed in the refill body, and, furthermore, the projections for backward-motion prevention, by which the sheet-type connected staples are prevented from moving to a direction opposite to the side of the delivery port, are formed in the refill body, backward movement of the sheet-type connected staples can be prevented, the sheet-type connected staples can be securely sent to the delivery port, and idle stapling caused by sending failure in a stapler can be prevented.

Moreover, the refill for staples has an advantage that, as the delivery port which delivers sheet-type connected staples is formed in the refill body, and, furthermore, the projections for backward-motion prevention, by which the sheet-type connected staples are prevented from moving to a direction opposite to the side of the delivery port, are formed in the bottom wall, backward movement of the sheet-type connected staples can be prevented, the sheet-type connected staples can be securely sent to the delivery port, and idle stapling caused by sending failure in a stapler can be prevented.

Moreover, the refill for staples has an advantage that, as the delivery port which delivers sheet-type connected staples is formed in the refill body, and, furthermore, the projections for backward-motion prevention, by which the sheet-type connected staples are prevented from moving to a direction opposite to the side of the delivery port, are formed in the pressing member, backward movement of the sheet-type connected staples can be prevented, the sheet-type connected staples can be securely sent to the delivery port, and idle stapling caused by sending failure in a stapler can be prevented.

Moreover, the refill for staples has an advantage that, as the delivery port which delivers sheet-type connected staples is formed in the refill body, and, furthermore, the projections for backward-motion prevention, by which the sheet-type connected staples are prevented from moving to a direction opposite to the side of the delivery port, are formed in the bottom wall and in the pressing member, backward movement of the sheet-type connected staples can be prevented, the sheet-type connected staples can be securely sent to the delivery port, and idle stapling caused by sending failure in a stapler can be prevented.

Moreover, the refill for staples has an advantage, other than the above-described advantages, that, as the projections for backward-motion prevention on the bottom wall are formed out of phase with the projections for backward-motion prevention on the pressing member, backward movement of the sheet-type connected staples can be further prevented.

Moreover, the refill for staples has an advantage that, as the pressing shaft in the pressing member pressing the sheet-type connected staple is engaged with the energizing unit provided in the stapler body, and the pressing member is energized in the pressing direction with the energizing unit when the refill body is mounted in the stapler body, or when the refill body is installed in the cartridge, and is mounted in the stapler body, reduction of the refill body in the weight and the cost can be realized, based on a configuration in which an elastic member such as a spring formed of a metallic material is not to be required. Furthermore, separate decomposition for each material is not required for discarding to cause simple discarding, and superior recyclability is obtained to promote resource-saving.

Moreover, the stapler has a configuration in which the energizing unit provided in the stapler body energizes the pressing member in the refill for staples in the pressing direction at about the same time the cartridge installing the refill for staples is pushed into the stapler body, and the pressing member in the refill for staples is stopped from being energized in the pressing direction at about the same time the cartridge is pulled out from the stapler body. Thereby, the refill for staples has an advantage that, as the elastic member such as a spring, which energizes the pressing member in the refill body of the refill for the staples in the pressing direction, is not required, reduction in the weight and the cost of the refill for staples can be realized.

Moreover, the stapler has an advantage, other than the above-described advantages, that, as the cartridge is provided in a detachable manner in the stapler body, a cartridge can be easily exchanged for a new one even when a trouble such as clogging of staples in the cartridge is caused.

Moreover, the stapler has an advantage, other than the above-described advantages, that, as the energizing unit is an arm member and an elastic member energizing the arm member, and the arm member energizes the guide shaft of the pressing member guided in the guide slots formed in both sides of the refill body, the structure becomes simple and the manufacturing cost is reduced. Furthermore, as energizing force caused by the energizing unit is applied in the direction in which the cartridge is pulled out, the cartridge can be more easily removed. Moreover, there is another advantage that, as the arm member is provided at each side, reduction in the height can be obtained to realize a small size. Furthermore, there is further another advantage that the position of the elastic member energizing the arm member can be freely changed. Moreover, there is another advantage that the operation force required for inserting the cartridge can be controlled by changing the shape of the arm member.

BEST MODE OF CARRYING OUT THE INVENTION

First Embodiment

Embodiments of a refill for staples and a stapler according to the present invention will be explained, referring to FIG.

Figure 2:
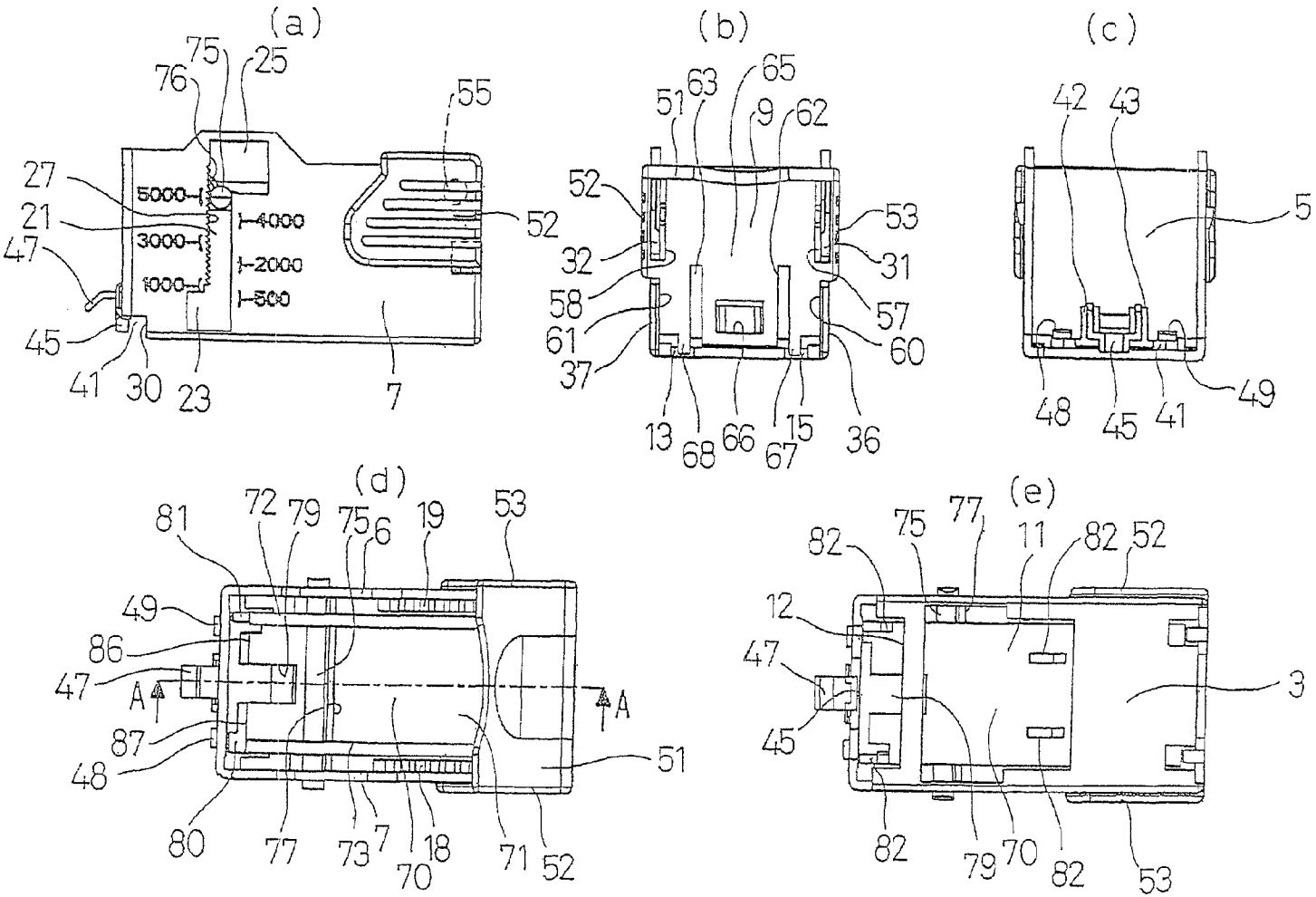
FIG. 2(A) is a view of the refill for staples shown in FIG. 1(A) through FIG. 1(C).
FIG. 2(B) is a view of the refill for staples shown in FIG. 1(A) through FIG. 1(C).
FIG. 2(C) is a view of the refill for staples shown in FIG. 1(A) through FIG. 1(C).
FIG. 2(D) is a view of the refill for staples shown in FIG. 1(A) through FIG. 1(C).
FIG. 2(E) is a view of the refill for staples shown in FIG. 1(A) through FIG. 1(C).
Figure 13:
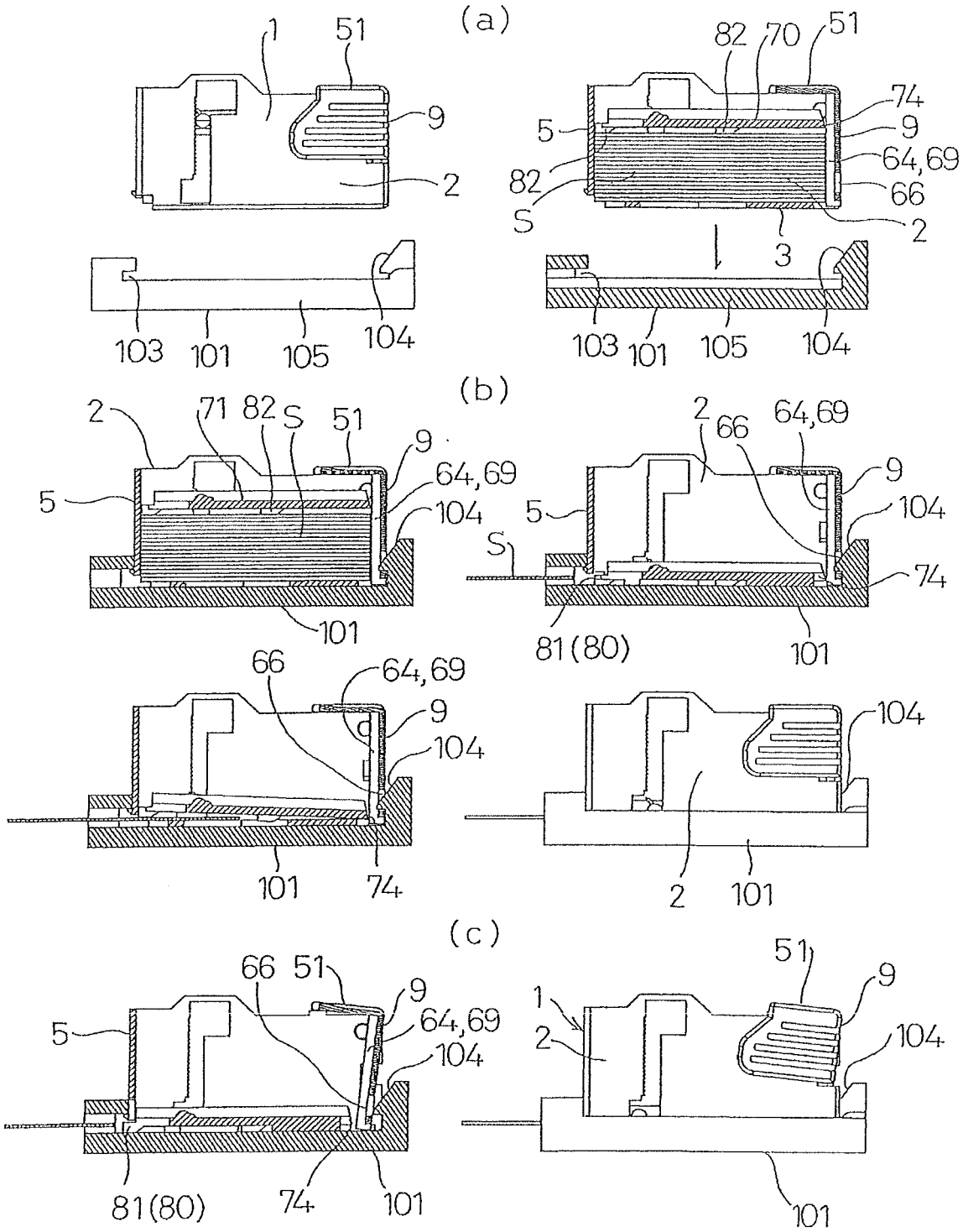
FIG. 13(A) is a side views explaining operations of the refill for staples in FIG. 9(A) through FIG. 9(F).
FIG. 13(B) is a side views explaining operations of the refill for staples in FIG. 9(A) through FIG. 9(F).
FIG. 13(C) is a side views explaining operations of the refill for staples in FIG. 9(A) through FIG. 9(F).

1(A) through FIG. 13(C). FIG. 1(A) through FIG. 1(C) are general perspective views showing a refill for staples according to the invention: FIG. 1(A) is a perspective view seen from ahead and above, FIG. 1(B) is a perspective view seen from behind and below, and FIG. 1(C) is a perspective view seen from ahead and below. FIG. 2(A) through FIG. 2(E) are six different views for the refill for staples shown in FIG. 1(A) through FIG. 1(C): FIG. 2(A) is a side view seen from left; FIG. 2(B) is a rear view; FIG. 2(C) is a front view; FIG. 2(D) is a top view; and FIG. 2(E) is a bottom view.

Figure 3:
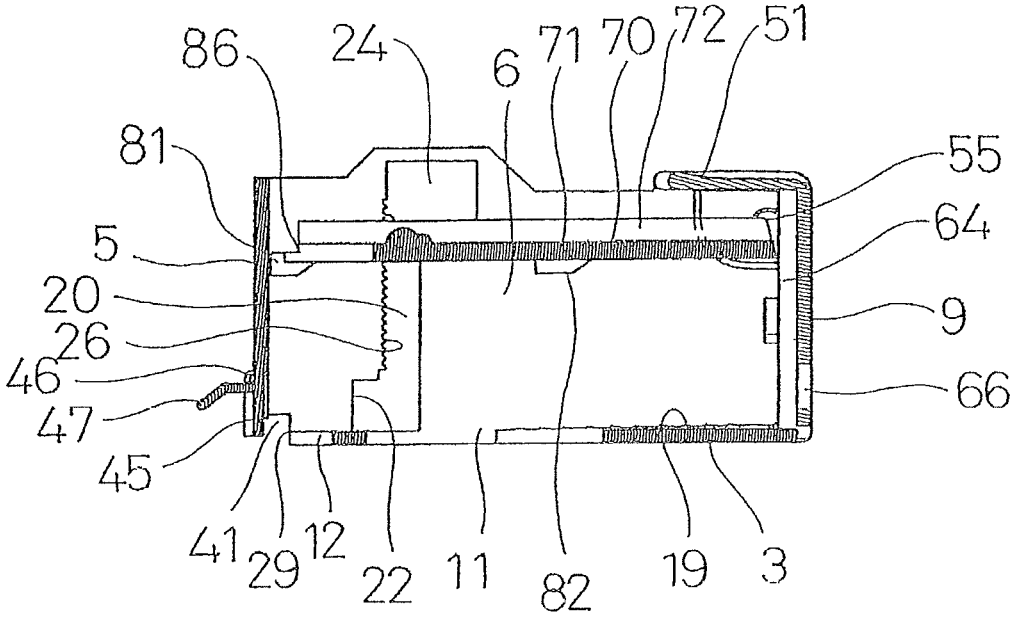
FIG. 3 is a sectional side view of the refill for staples shown in FIG. 1(A) through FIG. 1(C).
Figure 4:
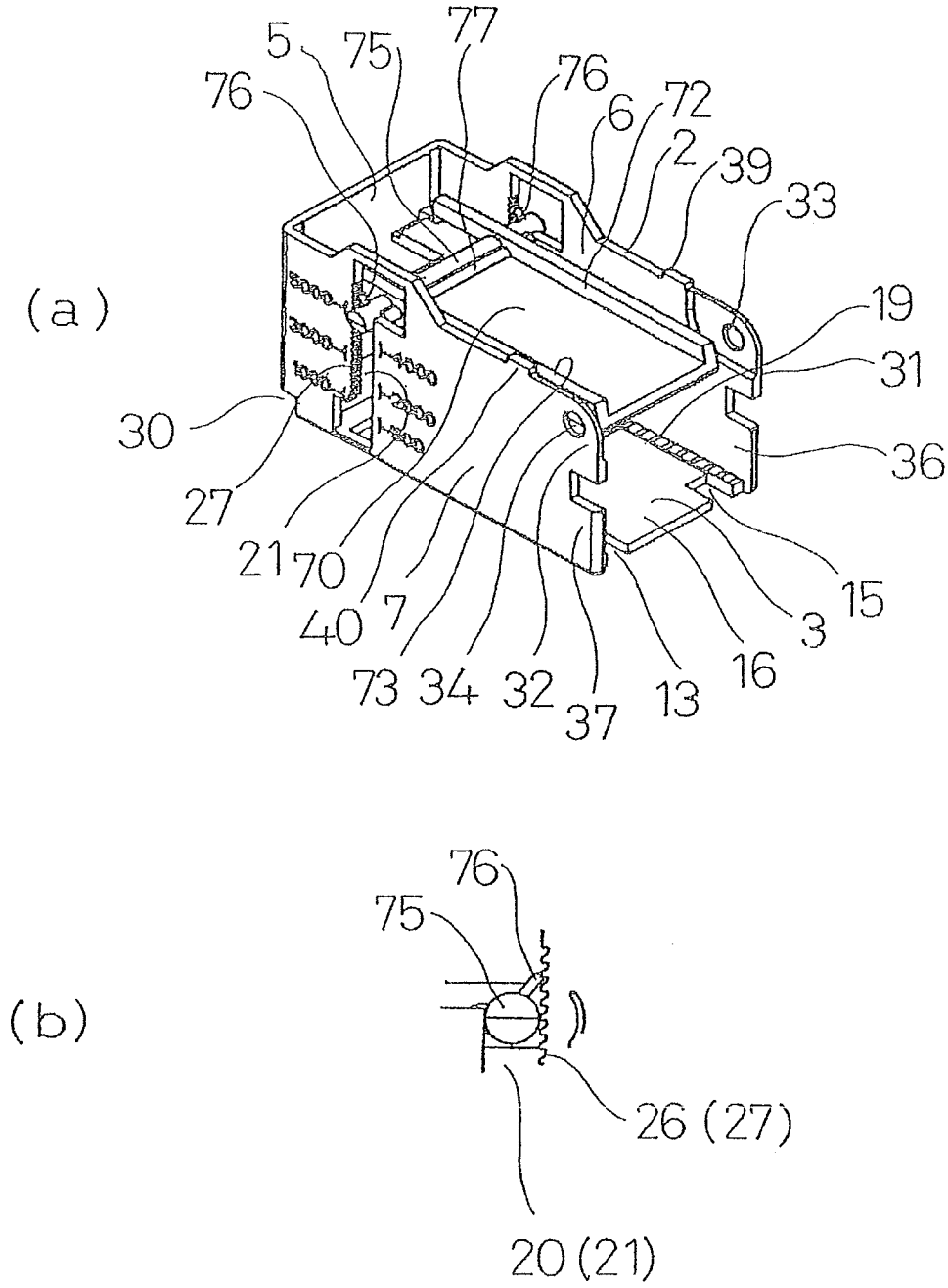
FIG. 4(A) is a principal explanatory view for the refill for staples shown in FIG. 1(A) through FIG. 1(C).
FIG. 4(B) is a principal explanatory view for the refill for staples shown in FIG. 1(A) through FIG. 1(C).
Figure 5:
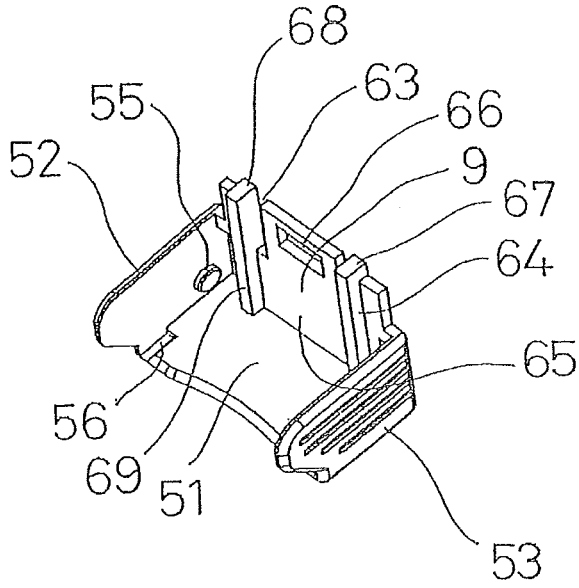
FIG. 5(A) is an explanatory view of the refill for staples shown in FIG. 1(A) through FIG. 1(C).
FIG. 5(B) is an explanatory view of the refill for staples shown in FIG. 1(A) through FIG. 1(C).
Figure 5:
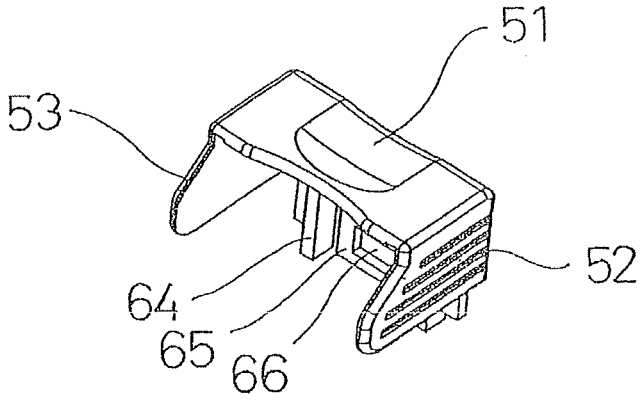

FIG. 3 is a sectional view of the refill for staples shown in FIG. 1(A) through FIG. 1(C), seen from the side. FIG. 4(A) and FIG. 4(B) are principal explanatory views for the refill for staples shown in FIG. 1(A) through FIG. 1(C): FIG. 4(A) is a perspective view of a state in which a locking plate is removed, seen from above and backward, and FIG. 4(B) is a principal enlarged view of a guide slot. FIG. 5(A) and FIG. 5(B) are explanatory views of a locking plate for the refill for staples shown in FIG. 1(A) through FIG. 1(C): FIG. 5(A) is a perspective view of the locking plate, seen from downward, and FIG. 5(B) is a perspective view of the locking plate, seen from above.

Figure 6:
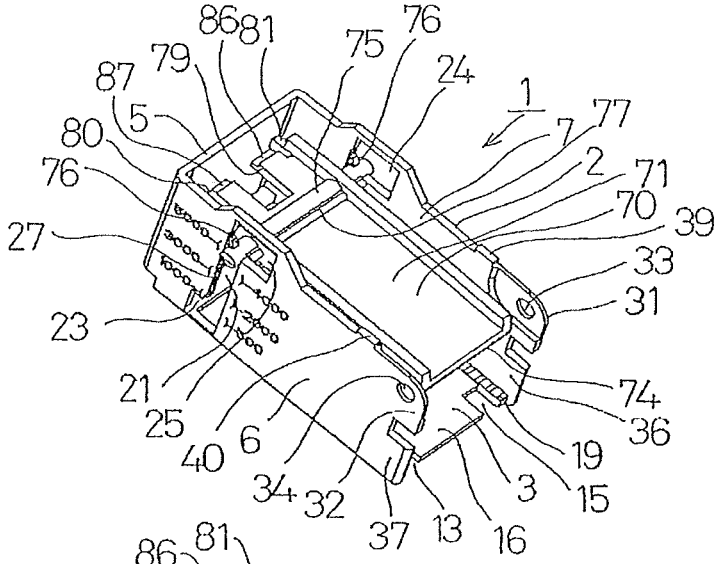
FIG. 6(A) is a perspective view of the refill for staples shown in FIG. 1(A) through FIG. 1(C).
FIG. 6(B) is a perspective view of the refill for staples shown in FIG. 1(A) through FIG. 1(C).
FIG. 6(C) is a perspective view of the refill for staples shown in FIG. 1(A) through FIG. 1(C).
Figure 6:
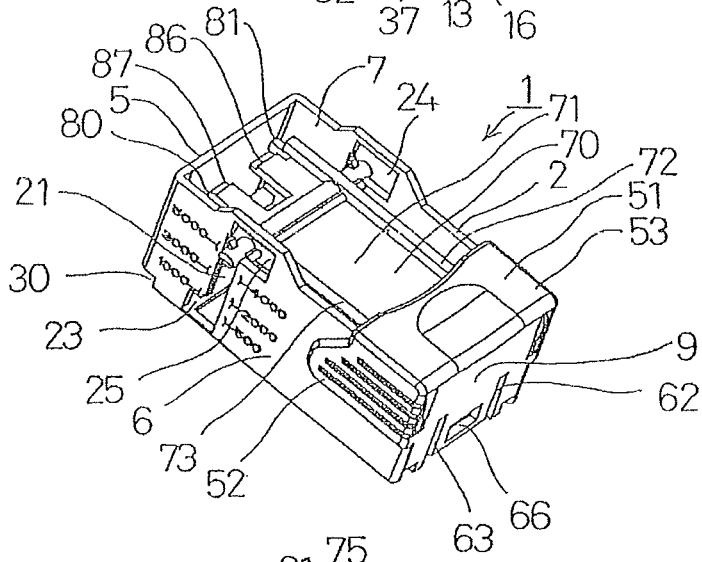
Figure 6:
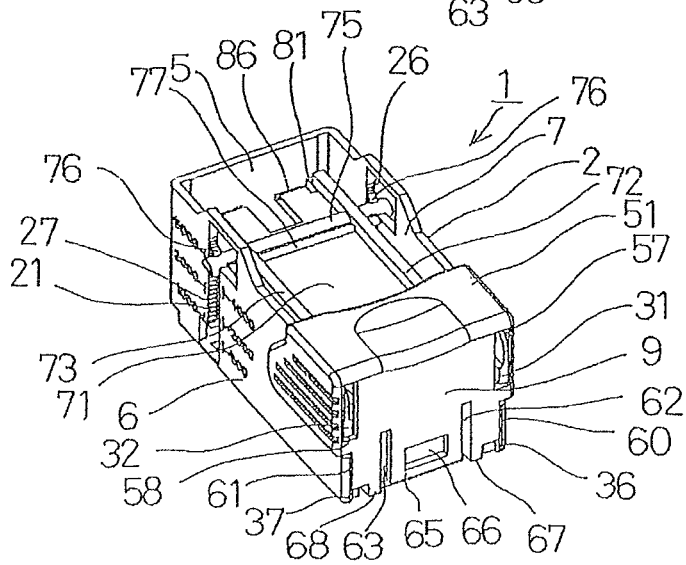
Figure 7:
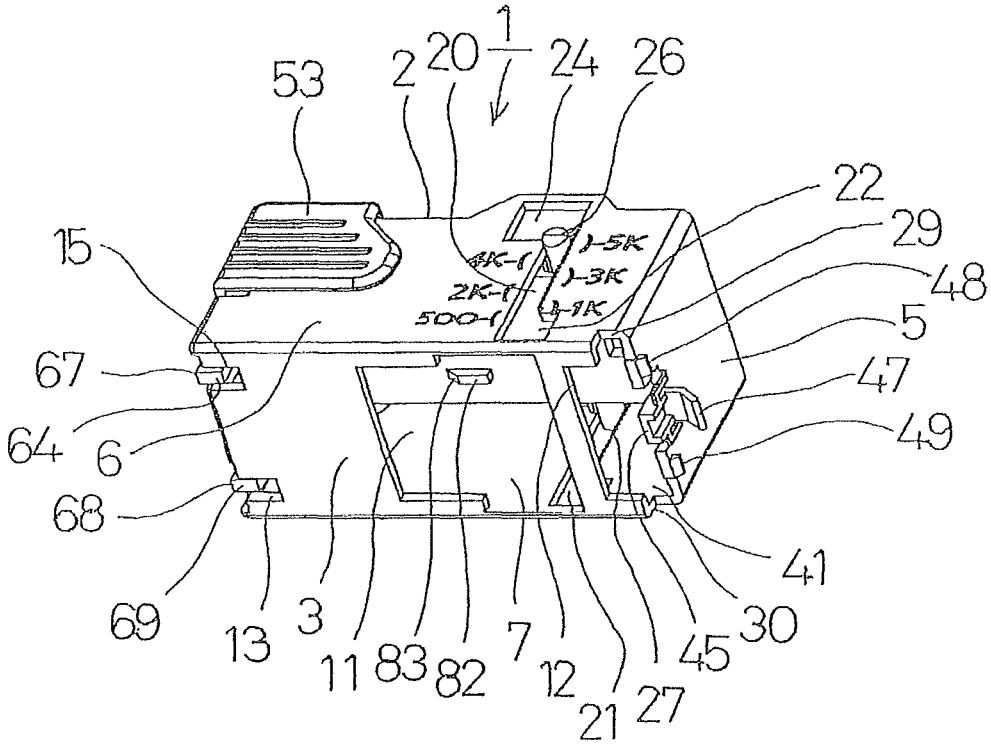
FIG. 7 is a general perspective view of the refill for staples shown in FIG. 1(A) through FIG. 1(C), seen from above and right.
Figure 8:
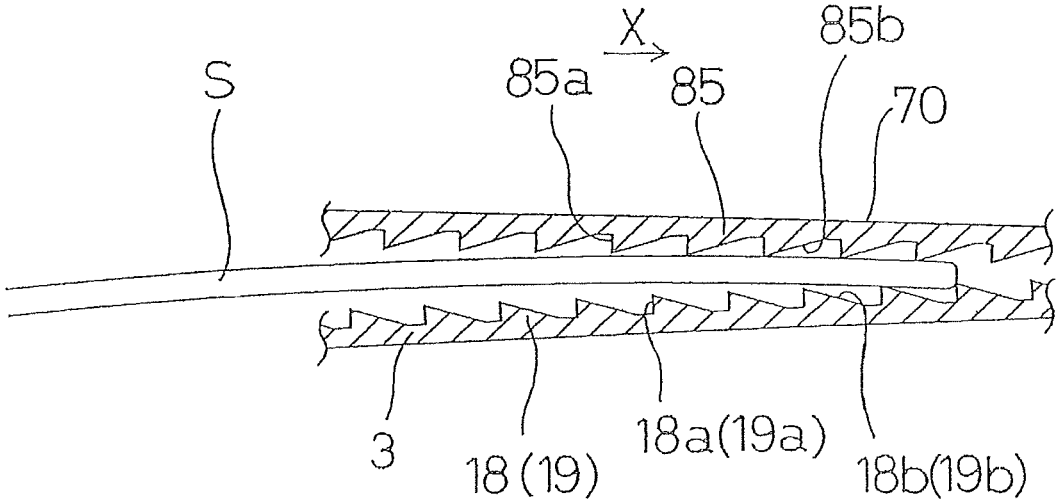
FIG. 8 is an explanatory view of projections for backward-motion prevention in the refill for staples shown in FIG. 1(A) through FIG. 1(C).

FIG. 6(A) through FIG. 6(C) are perspective views for the refill for staples shown in FIG. 1(A) through FIG. 1(C): FIG. 6(A) is a perspective view of a state in which the locking plate is removed, seen from above and left; FIG. 6(B) is a general perspective view seen from above and left; and FIG. 6(C) is a general perspective view, seen from above and left, which is different from FIG. 6(B). FIG. 7 is a general perspective view for the refill for staples shown in FIG. 1(A) through FIG. 1(C), seen from above and right. FIG. 8 is an explanatory view of projections for backward-motion prevention in the refill for staples shown in FIG. 1(A) through FIG. 1(C).

Figure 9:
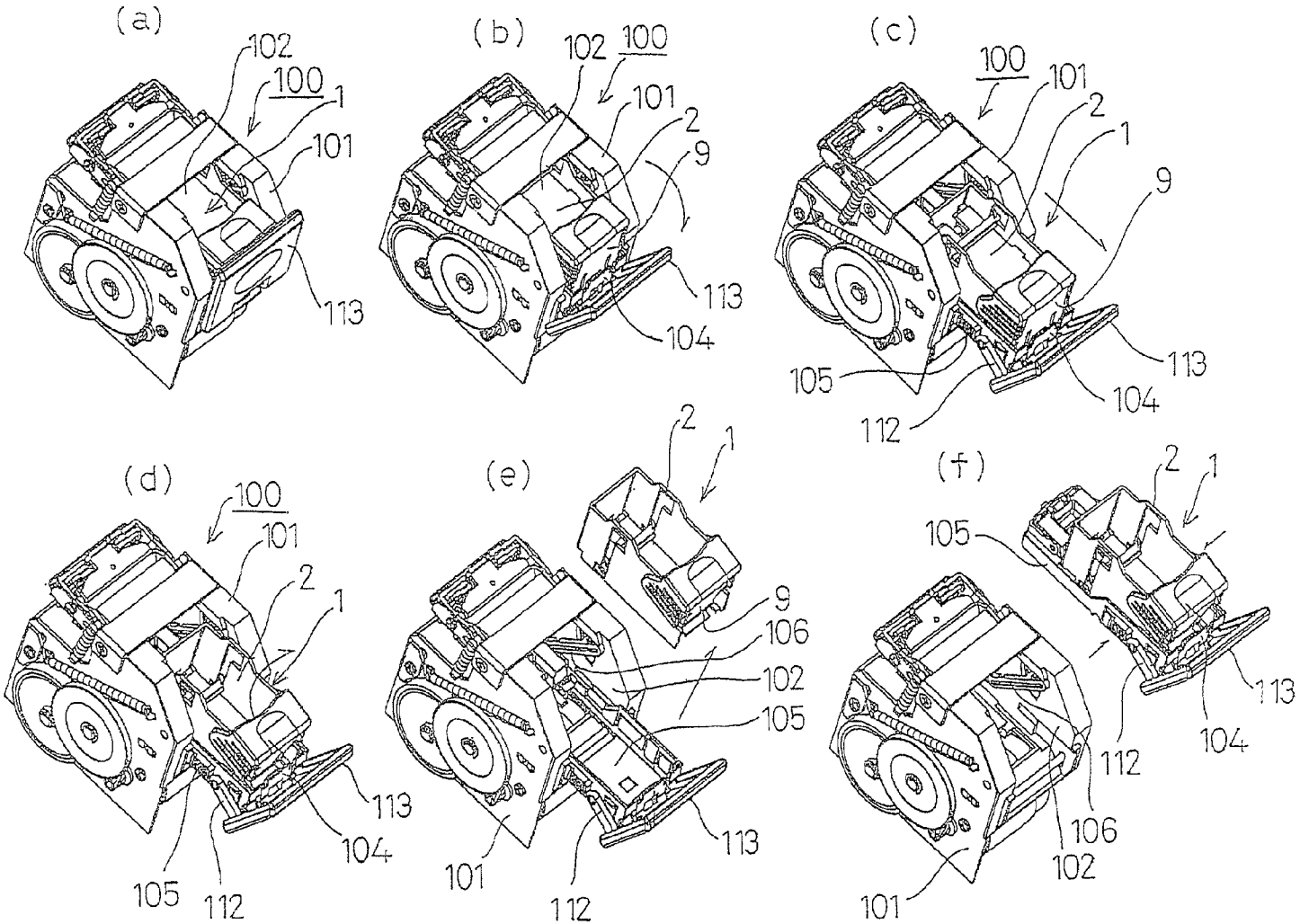
FIG. 9(A) is a general perspective view of a stapler body in a stapler according to one embodiment of the invention.
FIG. 9(B) is a general perspective view of the stapler body in the stapler according to one embodiment of the invention.
FIG. 9(C) is a general perspective view of the stapler body in the stapler according to one embodiment of the invention.
FIG. 9(D) is a general perspective view of the stapler body in the stapler according to one embodiment of the invention.
FIG. 9(E) is a general perspective view of the stapler body in the stapler according to one embodiment of the invention.
FIG. 9(F) is a general perspective view of the stapler body in the stapler according to one embodiment of the invention.

FIG. 9(A) through FIG. 9(F) are general perspective views of a stapler body according to one embodiment of the invention: FIG. 9(A) is a general perspective view seen from ahead and above; FIG. 9(B) is a general perspective view of a state in which a door of a cartridge is open; FIG. 9(C) is a general perspective view of a state in which the cartridge is pulled out; FIG. 9(D) is a general perspective view of a state in which the refill for staples is being removed from the cartridge; FIG. 9(E) is a general perspective view of a state in which the refill for staples has been removed from the cartridge; and FIG. 9(F) is a general perspective view of a state in which the cartridge is removed from the stapler body.

Figure 10:
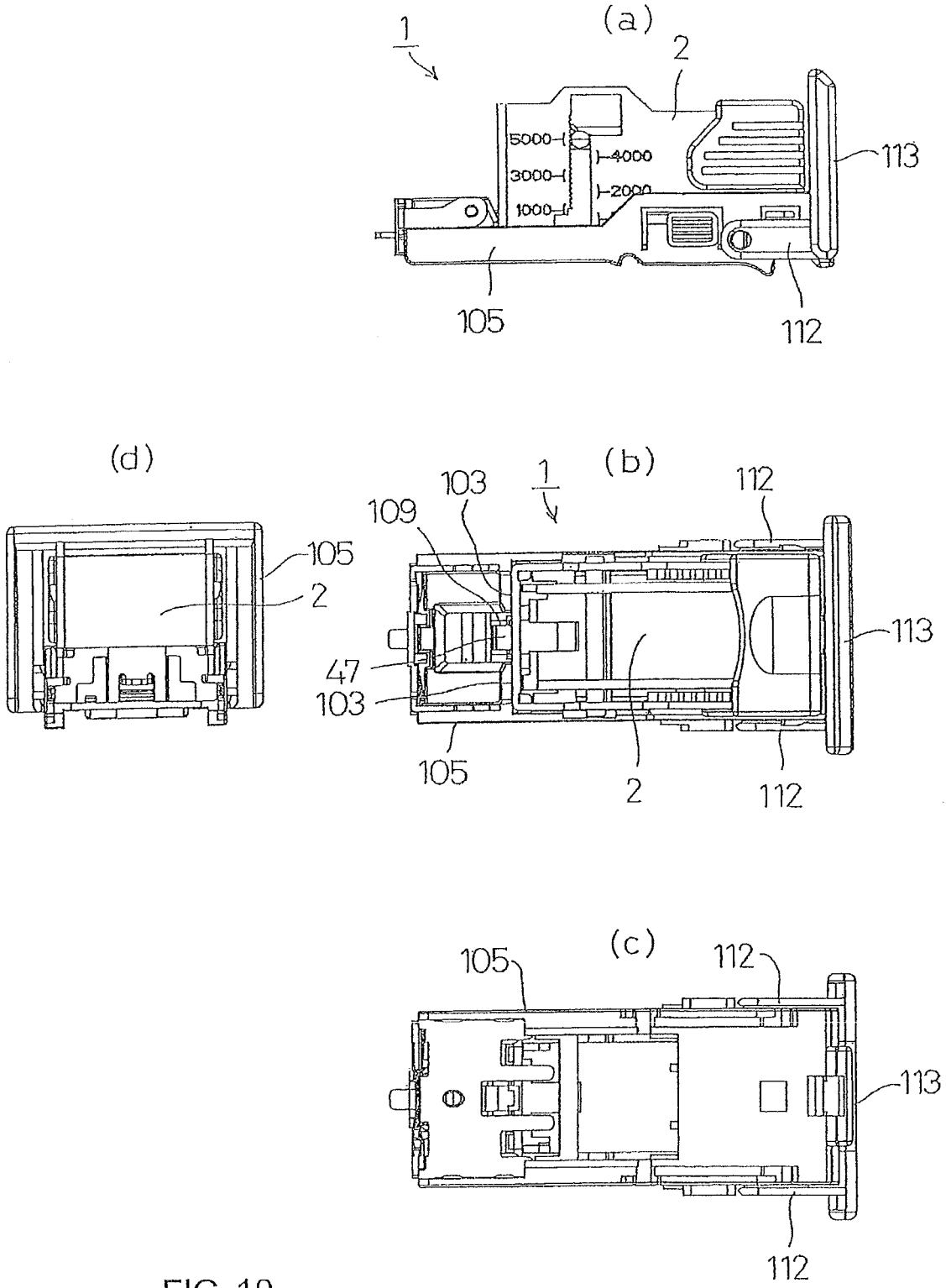
FIG. 10(A) is an explanatory view explaining a state in which the refill for staples is installed in the cartridge in FIG. 9(A) through FIG. 9(F).
FIG. 10(B) is an explanatory view explaining a state in which the refill for staples is installed in the cartridge in FIG. 9(A) through FIG. 9(F)
FIG. 10(C) is an explanatory view explaining a state in which the refill for staples is installed in the cartridge in FIG. 9(A) through FIG. 9(F).
FIG. 10(D) is an explanatory view explaining a state in which the refill for staples is installed in the cartridge in FIG. 9(A) through FIG. 9(F).
Figure 11:
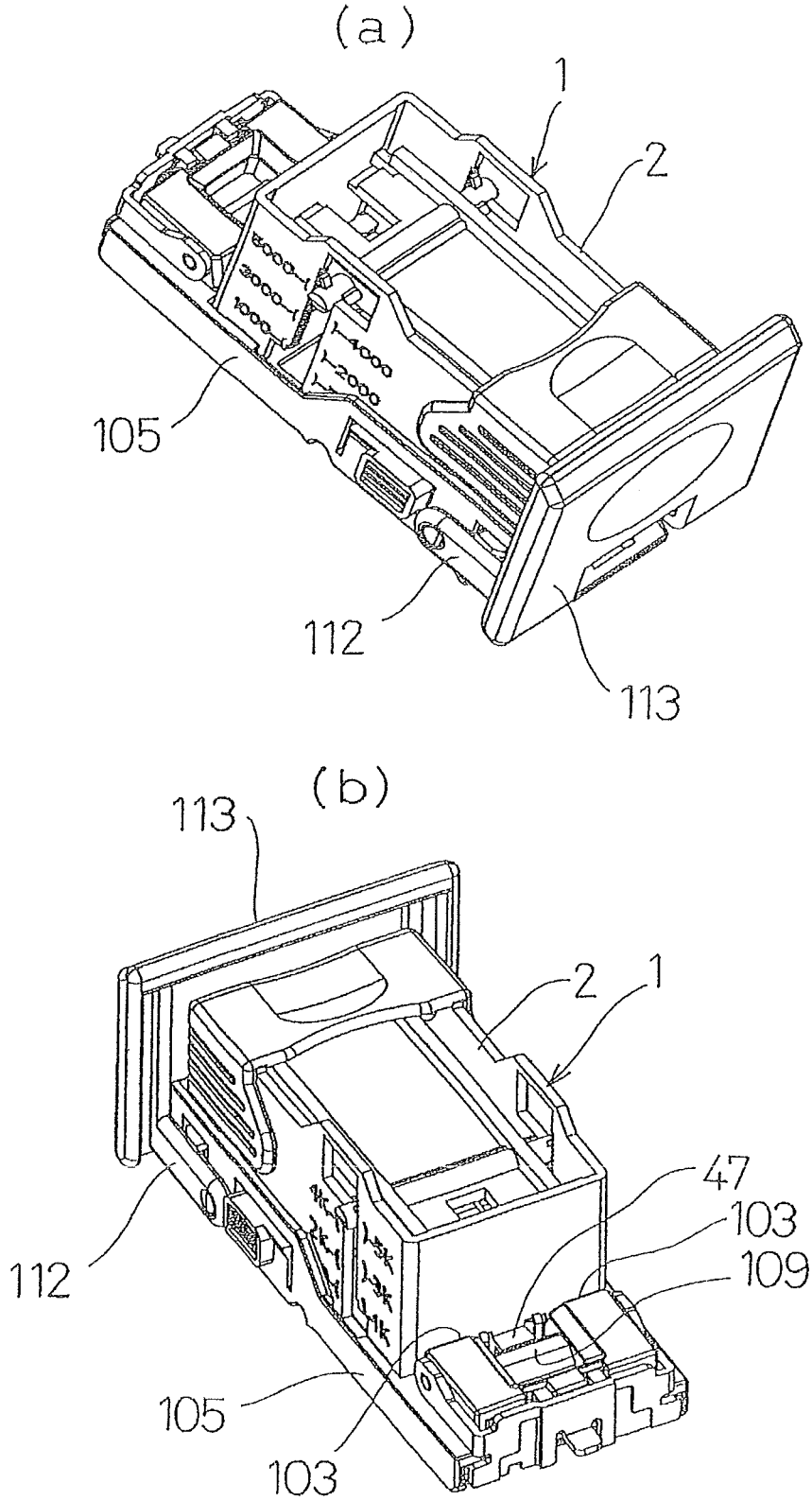
FIG. 11(A) is a general perspective view explaining a state in which the refill for staples is installed in the cartridge in FIG. 9(A) through FIG. 9(F)
FIG. 11(B) is a general perspective view explaining a state in which the refill for staples is installed in the cartridge in FIG. 9(A) through FIG. 9(F).

FIG. 10(A) through FIG. 10(D) are explanatory views explaining a state in which the refill for staples is installed in the cartridge in FIG. 9(A) through FIG. 9(F): FIG. 10(A) is a side view seen from the left side; FIG. 10(B) is a top view; FIG. 10(C) is a bottom view; and FIG. 10(D) is a front view. FIG. 11(A) and FIG. 11(B) are general perspective views explaining a state in which the refill for staples in FIG. 9(A) through FIG. 9(F) is installed in the cartridge: FIG. 11(A) is a general perspective view seen from above and behind; and FIG. 11(B) is a general perspective view seen from above and front.

Figure 12:
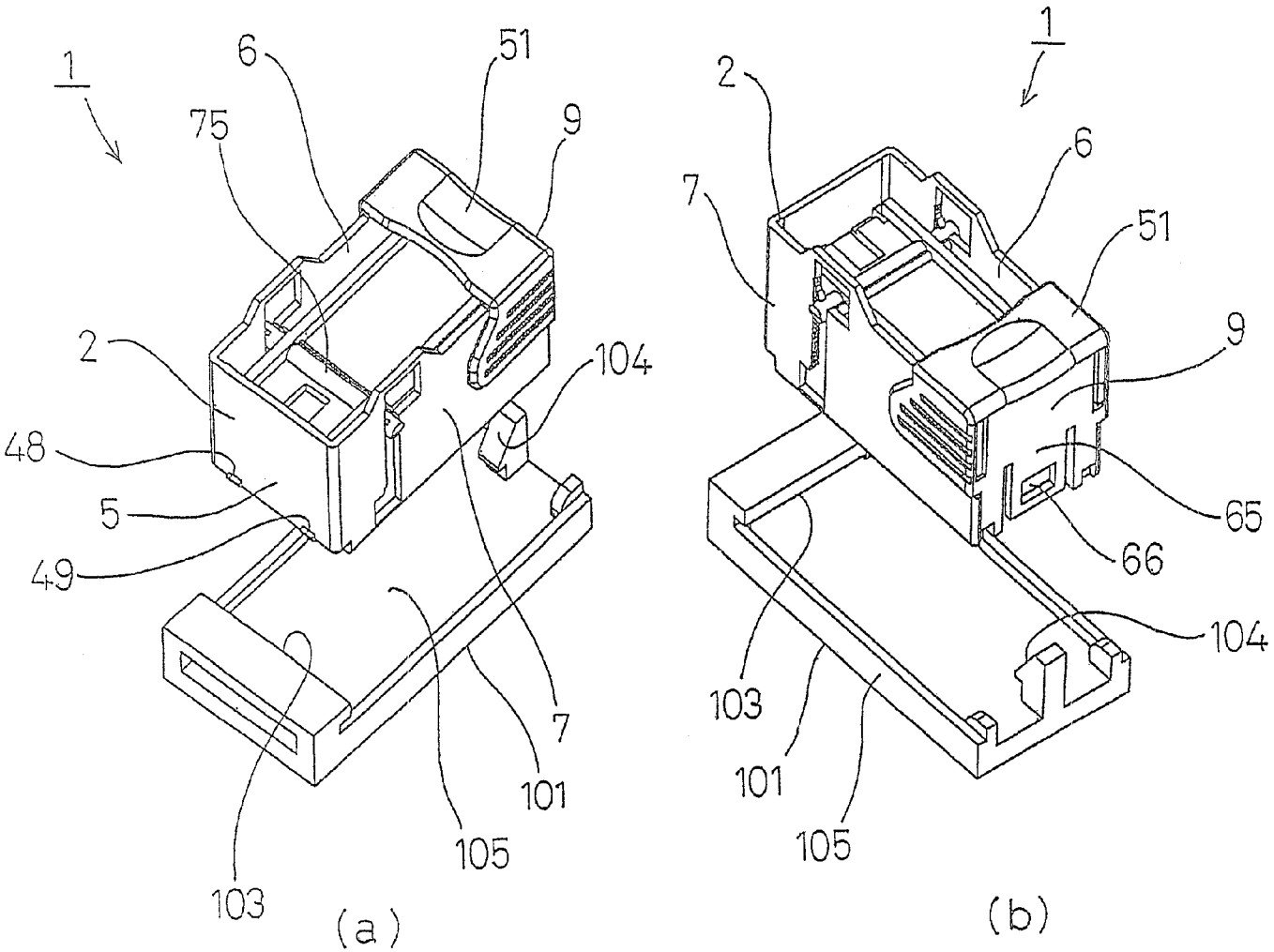
FIG. 12(A) is a perspective view showing a relation between the cartridge and the refill for staples in FIG. 9(A) through FIG. 9(F).
FIG. 12(B) is a perspective view showing a relation between the cartridge and the refill for staples in FIG. 9(A) through FIG. 9(F).

FIG. 12(A) and FIG. 12(B) are perspective views showing a relation between the cartridge in FIG. 9(A) through FIG. 9(F) and the refill for staples therein: FIG. 12(A) is a perspective view seen from ahead, above and right; and FIG. 12(B) is a perspective view seen from ahead, above and left. FIG. 13(A) through FIG. 13(C) are side views explaining operations of the refill for staples in FIG. 9(A) through FIG. 9(F): FIG. 13(A) is a side view of the refill before the refill is installed in the cartridge; FIG. 13(B) is a side view of the refill when the refill is installed in the cartridge; and FIG. 13(C) is a side view of the refill when the refill is separated from the cartridge. FIG. 14(A) through FIG. 14(K) are explanatory views explaining a refill for staples according to another embodiment.

A refill 1 for staples is configured to be installed in a detachable manner in a stapler body 101 or in a cartridge 105 provided in the stapler body 101. The refill 1 for staples is formed of a synthetic-resin material, and comprises a refill body 2 holding sheet-type connected staples S, and a pressing member 70 pressing the above-described sheet-type connected staples S movably provided in the refill body 2. The cartridge 105 may be included in the stapler body 101 in a detachable manner, or provided in the stapler body 101 in a fixed manner. A delivery port delivering the sheet-type connected staples S is formed in the refill body 2, and a locking plate 9 is provided at a side opposite to the delivery port 41. A locking section 66 locking a locked section 104, which is formed in the stapler body 101 or the cartridge 105, is provided in the locking plate 9.

The above-described pressing member 70 is a plate-like member which is formed so that an upper opening of a space accommodating the sheet-type connected staples S in the refill body 2 is almost covered, and rests on the uppermost sheet-type connected staple S among the laminated sheet-type connected staples S to have a function by which a sheet-type connected staple S is prevented from emitting from the refill body 2. That is, the above-described pressing member 70 has a function by which a sheet-type connected staple S is prevented from dropping off from the refill body 2 at carrying the refill 1 for staples, or at an operation during which the refill 1 is mounted in the cartridge 105.

Moreover, the pressing member 70 is engaged with the above-described locking plate 9 when the member 70 presses the sheet-type connected staples S. There can be a case in which the pressing member 70 can not prevent the locking plate 9 from moving in the unlocking direction when a position at which the member 70 is engaged with (rests on) the locking plate 9 is located at the upper portion of the locking plate 9. Even in this case, the locking plate 9 is prevented by being engaged with (resting on) the sheet-type connected staples S held in the refill body 2 from moving in the unlocking direction. Here, the pressing member 70 can more securely prevent the locking plate 9 from moving in the unlocking direction as a position at which the member 70 is engaged with (rests on) the plate 9 is lowered. When a position at which the pressing member 70 is engaged with (rests on) the locking plate 9 is located at the lower portion of the plate 9, the member 70 is configured to prevent the plate 9 from moving in the unlocking direction, and the locking section 66 in the locking plate 9 from getting out of the locked section 104 in the stapler body 101 or the cartridge 105.

The locking section 66 provided in the locking plate 9 has a function by which the section 66 is engaged with the locked section 104 in the stapler body 101 or the cartridge 105 to prevent the refill 1 for staples mounted in the stapler body 101 or the cartridge 105 from being separated.

When all the sheet-type connected staples S are delivered, and the pressing member 70 no longer presses the sheet-type connected staples S (there is no sheet-type connected staples S to be pressed by the member 70), the member 70 is no longer engaged with the above-described locking plate 9 to allow movement of the locking plate 9 in the unlocking direction. The locking section 66 can be configured to be removed from the locked section 104 of stapler body 101 or cartridge 105 by movement (rotation) of the locking plate 9 caused by movement of the pressing member 70.

The refill body 2 comprises: a bottom wall 3, a front wall 5 provided at the front portion of a bottom wall 3; a right wall 6 provided at the right portion of the bottom wall 3; a left wall 7 provided at the left portion of the bottom wall 3; and the above-described locking plate 9 rotatably provided at the rear portion of the bottom wall 3. The above-described delivery port 41 is formed in the lower portion of the front wall 5. The delivery port 41 is configured to have dimensions and a shape by which only one sheet-type connected staple S at the lowest layer of the refill body 2 passes through the port 41, and the subsequent staples are prevented from being delivered from the port 41.

Guide projections 80 and 81 resting on the front wall 5 are formed at the front portion of the above-described pressing member 70. When the pressing member 70 presses the sheet-type connected staple S, the guide projections 80 and 81 rest on the front wall 5 to limit the forward movement of the member 70, and a rear portion 74 is engaged with (rests on) the locking plate 9. There can be a case in which the pressing member 70 can not prevent the locking plate 9 from rotating in the unlocking direction when a position at which the member 70 is engaged with (rests on) the plate 9 is located at the upper portion of the locking plate 9. Even in this case, the locking plate 9 is prevented by being engaged with (resting on) the sheet-type connected staples S held in the refill body 2 from moving in the unlocking direction. Here, the pressing member 70 can more securely prevent the locking plate 9 from rotating in the unlocking direction as a position at which the member 70 is engaged with (rests on) the plate 9 is lowered. When a position at which the pressing member 70 is engaged with (rests on) the locking plate 9 is located at the lower portion of the plate 9, the member 70 is configured to prevent the plate 9 from rotating in the unlocking direction.

When the pressing member 70 no longer presses the sheet-type connected staples S, the guide projections 80 and 81 get out of the front wall 5 to be allowed for forward movement of the member 70. Thereby, the locking plate 9 resting on the rear portion 74 is allowed to be rotated in the unlocking direction. That is, when there is no sheet-type connected staple 5, forward movement of the pressing member 70 in the refill body 2 is allowed to permit rotation of the locking plate 9. Thereby, the rotation of the locking plate 9 can unlock the cartridge 105 and the like to remove the refill 1 for staples.

Moreover, a guide slot 20 extending in the vertical direction is provided on the above-described right wall 6, and a concave portion 22 is formed toward the front in the lower portion of the guide slot 20. Similarly, a guide slot 21 extending in the vertical direction is provided on the above-described left wall 7, and a concave portion 23 is formed toward the front in the lower portion of the guide slot 21. The above-described pressing member 70 has a guide shaft 75 guided in the guide slots 20 and 21. When the member 70 presses the sheet-type connected staples S, the right end of the guide shaft 75 is guided in the guide slot 20, and the left end of the guide shaft 75 is guided in the guide slot 21. Moreover, the guide slots 20 and 21 has a function by which vertical movement of the guide shaft 75 is allowed and fore-and-aft movement is limited. When the guide shaft 75 is guided in the guide slots 20 and 21, the rear portion 74 of the pressing member 70 rests on the locking plate 9. There can be a case in which the pressing member 70 can not prevent the locking plate 9 from rotating in the unlocking direction when a position at which the member 70 rests on the plate 9 is located at the upper portion of the locking plate 9. Even in this case, the locking plate 9 is prevented by being engaged with (resting on) the sheet-type connected staples S held in the refill body 2 from moving in the unlocking direction. Here, the pressing member 70 can more securely prevent the locking plate 9 from rotating in the unlocking direction as a position at which the member 70 rests on the plate 9 is lowered. When a position at which the pressing member 70 rests on the locking plate 9 is located at the lower portion of the plate 9, the member 70 is configured to prevent the plate 9 from rotating in the unlocking direction.

When the pressing member 70 no longer presses the sheet-type connected staples S, the guide shaft 75 is configured to get out of the guide slots 20 and 21, and enters into the concave portions 22 and 23. In this case, the pressing member 70 can be moved forward and the rear portion 74 is no longer engaged with the locking plate 9. Thereby, the locking plate 9 can be rotated in the unlocking direction.

As described above, the refill 1 for staples is installed in the stapler body 101, or the cartridge 105 provided in the in the stapler body 101, and has the refill body 2 holding the sheet-type connected staple S. The delivery port 41 delivering the sheet-type connected staples S, and a covering member 45 (delivery control unit) which closes the delivery port 41 are provided in the refill body 2. The covering member 45 is a member which is configured to be engaged with one side 109 of the stapler body 101 or the cartridge 105 for opening the delivery port 41 when the refill body 2 is mounted in the stapler body 101 or the cartridge 105.

The above-described covering member 45 is configured to be engaged with one side 109 of the stapler body 101 or the cartridge 105 for opening the delivery port 41 when the refill body 2 is mounted in the stapler body 101 or the cartridge 105.

The delivery port 41 delivering the sheet-type connected staples S and the projections for backward-motion prevention 18, 19, 85 for preventing the sheet-type connected staples S from moving in a direction opposite to that toward the delivery port 41 are formed in the refill body 2. The projections for backward-motion prevention 18 and 19 are formed on the bottom wall 3, and the projections for backward-motion prevention 85 are formed on the pressing member 70. The projections for backward-motion prevention 85 on the pressing member 70 are formed out of phase with the projections for backward-motion prevention 18, 19 on the bottom wall 3. The projections for backward-motion prevention according to the present embodiment have a configuration in which a projection with a shape of saw blades having an inclined side and a vertical side is arranged along the delivery direction. The top of each projection is engaged with gaps formed between staples, or rear ends of the sheet-type connected staples S, and prevents the sheet-type connected staples S from moving in the direction (backward direction) in which a top climbs over a vertical side.

As described above, the pressing member 70 has the guide shaft 75 guided in the above-described guide slots 20 and 21. The guide shaft 75 is configured to be engaged with energizing units (106, 106) provided in the stapler body 101 when the refill body 2 is mounted in the stapler body 101, or when the refill body 2 is installed in the cartridge 105, and is mounted in the stapler body 101. Then, the pressing member 70 is configured to be energized in the pressing direction (a direction in which the sheet-type connected staples S are laminated) by energizing the guide shaft 75 with the energizing units.

A stapler 100 is provided with the cartridge 105 which can install the refill 1 for staples in a detachable manner. The refill 1 for staples holds the sheet-type connected staples S, and, at the same time, is provided with the pressing member 70 pressing the sheet-type connected staples S. The cartridge 105 is provided in the stapler body 101 in such a way that the cartridge 105 can be pulled out from the body 101.

The above-described energizing units (106, 106) energize the pressing member 70 of the refill 1 for staples installed in the cartridge 105 at about the same time the cartridge 105 is pushed into the stapler body 101, and, when the cartridge 105 is pulled out from the stapler body 101, the pressing member 70 of the refill 1 for staples installed in the cartridge 105 is stopped from being energized in the pressing direction.

The cartridge 105 may be provided in the stapler body 101 in a detachable manner. The energizing unit comprises arm members 106, 106 and an elastic member energizing the arm members 106, 106. One of the arm member 106 is configured to rest on one end of the guide shaft 75 guided in the guide slots 20 and 21 respectively formed on the both sides of the refill body 2, and to press the pressing member 70 downward through the guide shaft 75. The other arm member 106 is configured to rest on the other end of the guide shaft 75 guided in the guide slots 20 and 21 respectively formed on the both sides of the refill body 2, and to press the pressing member 70 downward through the guide shaft 75.

Moreover, the refill for staples and the stapler will be explained in detail. As described above, the refill 1 for staples comprises the refill body 2 and the pressing member 70 as shown in FIG. 1(A) through FIG. 1(C). The refill body 2 comprises the bottom wall 3, the front wall 5 provided at about right angles to the front portion of the bottom wall 3, the right wall 6 provided at about right angles to the right portion of the bottom wall 3, the left wall 7 provided at about right angles to the left portion of the bottom wall 3, and the locking plate 9 rotatably provided at the rear portion of the bottom wall 3. Moreover, the bottom wall 3, the front wall 5, the right wall 6, and the left wall 7 form a accommodation chamber accommodating the laminated sheet-type connected staples S.

The bottom wall 3 forms a bottom surface for the accommodation chamber accommodating the sheet-type connected staples S, and has a look-through hole with a rectangular shape 11 at about the center, a notch 12 with a shape of substantially "U" at the front end, and a pair of concave portions 13 and 15 with a shape of substantially "U" at the rear end.

The projections for backward-motion prevention 18 are continuously formed at the left side on the upper surface (inner surface of the accommodation chamber) 16 of the bottom wall 3, and the projections for backward-motion prevention 19 are continuously formed at the right side on the upper surface (inner surface of the accommodation chamber) 16 of the bottom wall 3. The projection for backward-motion prevention 18 (19) has a shape of a saw blade having a vertical side 18*a* (19*a*) and an inclined side 18*b* (19*b*), and the vertical side 18*a* (19*a*) is located forward of the inclined side 18*b* (19*b*) as show in FIG. 8. Furthermore, the tops of the projections for backward-motion prevention 18 and 19 are continuously formed in such a way that the height of the tops is greater as the tops are located to the rear (X direction).

The guide slot 20 extending in the vertical direction is formed on the front portion of the right wall 6, and the guide slot 21 extending in the vertical direction is formed on the front portion of the left wall 7. The concave portion 22 is formed to the front at the lower end of the guide slot 20, and the concave portion 23 is formed to the front at the lower end of the guide slot 21. The concave portion 24 is formed to the rear at the upper end of the guide slot 20, and the concave portion 25 is formed to the rear at the upper end of the guide slot 21. Small projections 26 with a substantially triangle shape are continuously formed at the front edge of the guide slot 20 as a rack, and small projections 27 with a substantially triangle shape are continuously formed at the front edge of the guide slot 21 as a rack. A notch 29 with a substantially "L" shape communicating with the notch 12 of the above-described bottom wall 3 is formed in the front and lower portion of the right wall 6, and a notch 30 with a substantially "L" shape communicating with the notch 12 of the bottom wall 3 is formed in the front and lower portion of the left wall 7.

Moreover, a bearing piece 31 is extending in the rear and upper portion of the right wall 6, and this bearing piece 31 is provided with a bearing hole 33. Similarly, a bearing piece 32 is extending in the rear and upper portion of the left wall 7, and this bearing piece 32 is provided with a bearing hole 34. Furthermore, a guide piece 36 is provided in the rear and lower portion of the right wall 6, and a guide piece 37 is provided in the rear and lower portion of the left wall 7. An engaging projection 39 is formed in the rear portion of the upper-end edge in the right wall 6, and an engaging projection 40 is formed in the rear portion of the upper-end edge in the left wall 7.

The delivery port 41 delivering the sheet-type connected staples S is formed in the lower portion of the front wall 5. This delivery port 41 is in communication with the notch 29 of the above-described right wall 6, the notch 30 of the left wall 7, and the notch 12 of the bottom wall 3.

The covering member 45 closing the delivery port 41 is provided in the upper portion of the delivery port 41, using slots 42 and 43. The upper end of the covering member 45 is connected with the lower portion of the front wall 5 through a connecting section 46. Moreover, a resting member 47, which is slightly curved toward the front, is provided as a resting unit.

Before the refill 1 for staples is mounted, the covering member 45 is located in such a way that the member 45 rests on the front end of the sheet-type connected staple S which is going to move forward. Thereby, the sheet-type connected staple S is prevented from falling off in a careless manner. Moreover, the covering member 45 has a configuration in which, when the refill 1 for staples is mounted in the cartridge, the resting member 47 is pressed to slightly rotate the covering member 45 by the pressing, and control for the sheet-type connected staples S is released to allow the delivery of the staples.

Moreover, a pair of locking sections 48 and 49, which have a shape of a projection and are protruding forward, are formed at the both ends in the lower portion of the front wall 5 respectively.

Here, the above-described covering member 45 has a shape of a plate as shown in FIG. 1(A) through FIG. 3. But the member 45 may be of a covering member 45*a* shown in FIG. 14(A) through FIG. 14(K). This covering member 45*a* comprises a base portion 44*a* and a projected portion 44*b* to form a shape of substantially "L", and is connected with the lower portion of the projection 5*a* formed on the front wall 5 through a thin-walled connecting section 46*a*. Moreover, a resting member 47*a* is extending forward from the member 45. The connecting section 46*a* is formed as a thin-wall shaped one by concave portions 46*b*, 46*b* with a semicircle shape formed at both right and left sides, and is of a thick-wall shape in the fore-and-aft direction (in the direction in which the sheet-type connected staples S are delivered). Thereby, the connecting section 46*a* is easily bent in the transverse (right and left) direction (in the X direction in FIG. 14(E)), and is not easily bent in the fore-and-aft direction (in the direction in which the sheet-type connected staples S are delivered, and in the Y direction in FIG. 14(G)). Accordingly, the covering member 45*a* has a configuration in which the member 45*a* is not easily rotated in the direction to the thick-wall side of the connecting section 46*a* (in the Y direction in FIG. 14(G)), but the member 45*a* is easily rotated in the direction to the thin-wall side of the connecting section 46*a*

Figures 14A, 14B, 14C, 14D, 14E, 14F, 14G, 14H, 14I, 14J, 14K:
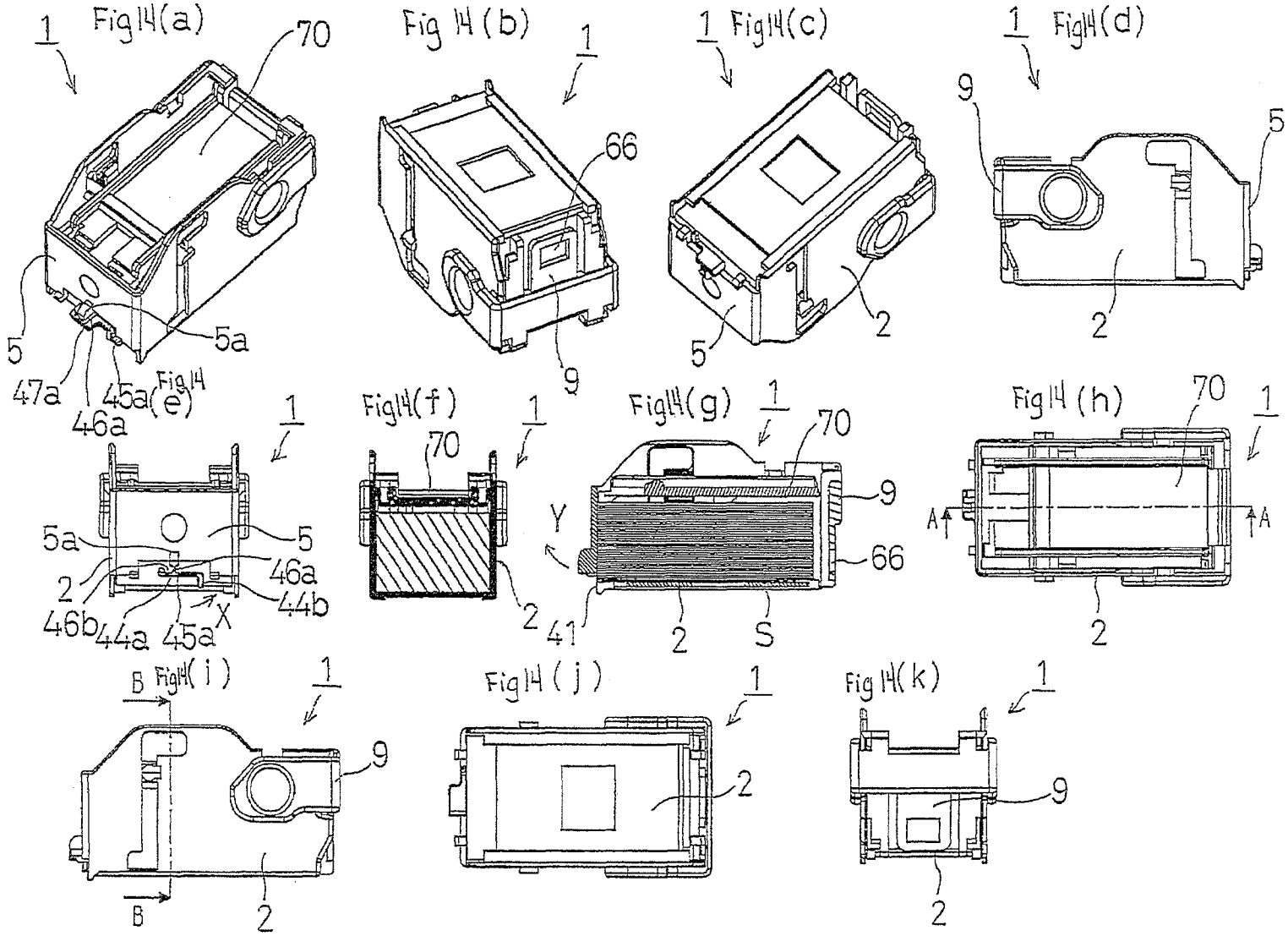
FIG. 14(A) is an explanatory view explaining a refill for staples according to another embodiment.
FIG. 14(B) is an explanatory view explaining the refill for staples according to another embodiment.
FIG. 14(C) is an explanatory view explaining the refill for staples according to another embodiment.
FIG. 14(D) is an explanatory view explaining the refill for staples according to another embodiment.
FIG. 14(E) is an explanatory view explaining the refill for staples according to another embodiment.
FIG. 14(F) is an explanatory view explaining the refill for staples according to another embodiment.
FIG. 14(G) is an explanatory view explaining the refill for staples according to another embodiment.
FIG. 14(H) is an explanatory view explaining the refill for staples according to another embodiment.
FIG. 14(I) is an explanatory view explaining the refill for staples according to another embodiment.
FIG. 14(J) is an explanatory view explaining the refill for staples according to another embodiment.
FIG. 14(K) is an explanatory view explaining the refill for staples according to another embodiment.
Figure 15:
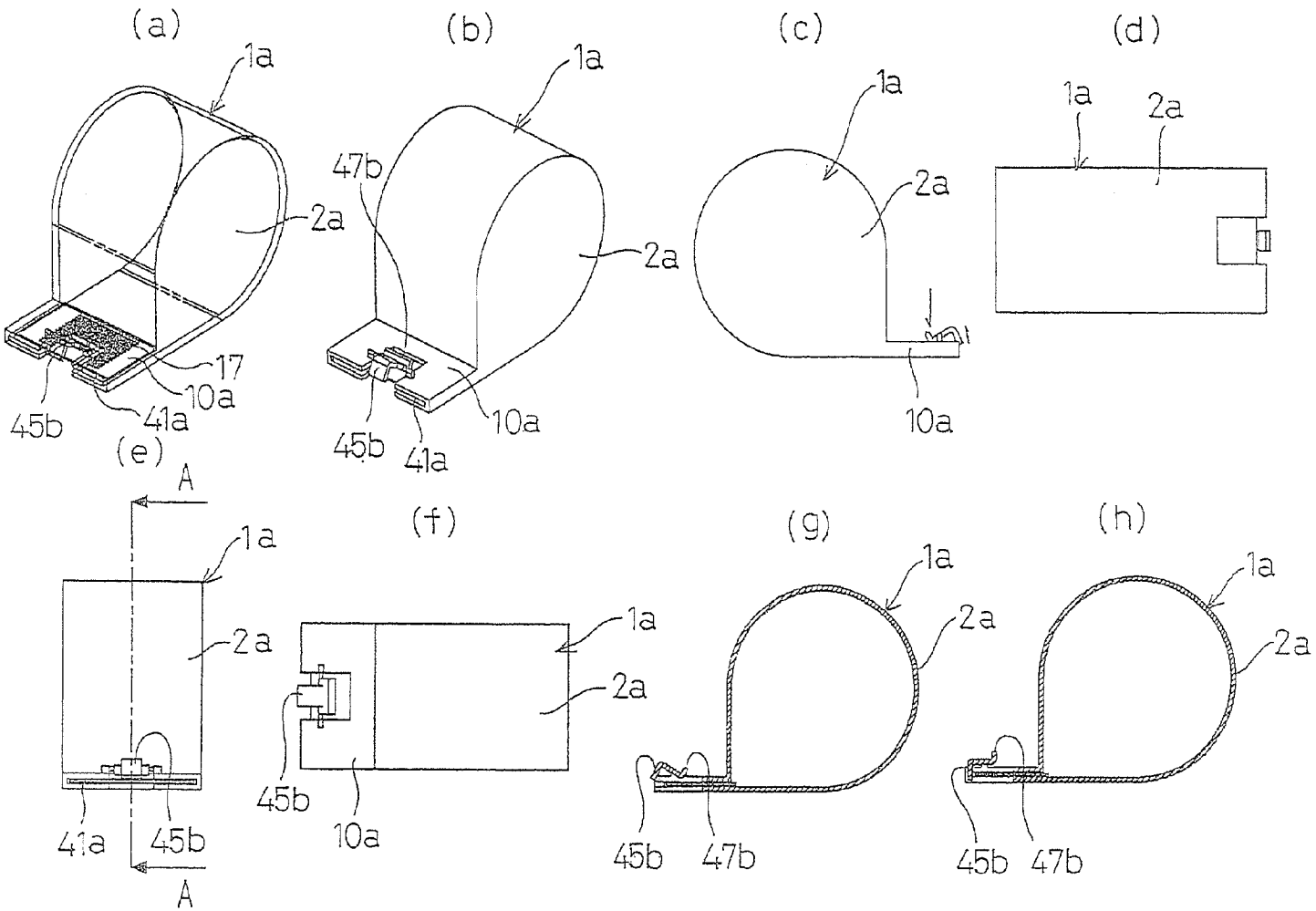
FIG. 15(A) is an explanatory view explaining a refill for staples according to another embodiment.
FIG. 15(B) is an explanatory view explaining the refill for staples according to another embodiment.
FIG. 15(C) is an explanatory view explaining the refill for staples according to another embodiment.
FIG. 15(D) is an explanatory view explaining the refill for staples according to another embodiment.
FIG. 15(E) is an explanatory view explaining the refill for staples according to another embodiment.
FIG. 15(F) is an explanatory view explaining the refill for staples according to another embodiment.
FIG. 15(G) is an explanatory view explaining the refill for staples according to another embodiment.
FIG. 15(H) is an explanatory view explaining the refill for staples according to another embodiment.

(in the X direction in FIG. 14(E)). The covering member 45*a* rests on the sheet-type connected staples S in the direction to the thick-wall side of the connecting section 46*a*. Thereby, the sheet-type connected staples S can be surely prevented from emitting from the refill body.

As shown in FIG. 5(A) and FIG. 5(B), a cover plate 51 is formed as one body on the upper end of the locking plate 9, a bearing plate 52 is formed as one body in the upper portion of the left end in the cover plate 51, and a bearing plate 53 is formed as one body in the upper portion of the right end in the cover plate 51. A rod 55, which is rotatably pivoted in engagement with the bearing hole 33 formed on the right wall 6, is provided in the inner surface of the bearing plate 52, and a rod 55, which is rotatably pivoted in engagement with the bearing hole 34 formed on the left wall 7, is provided in the inner surface of the bearing plate 53. An engaging concave section portion 56, which is engaged with the engaging projection 39 provided on the right wall 6, is provided on one side of the inner surface of the cover plate 51, and an engaging concave section portion 56, which is engaged with the engaging projection 40 provided on the left wall 7, is provided on one side of the inner side of the cover plate 51.

Moreover, uneven surfaces with a plurality of grooves for holding there with fingers are formed on the outside surfaces of the bearing plates 52 and 53. When the refill is lifted by holding the uneven portions with fingers, the locking plate 9 can be rotated around the above-described rod (55, 55) (the bearing holes 33 and 34) to rotate a flexible piece 65 in the fore-and-aft direction.

A rectangular and long hole 57 engaged with the bearing piece 31 on the right wall 6 with a play is formed on the upper portion of the locking plate 9, and a rectangular and long hole 58 engaged with the bearing piece 32 on the right wall 7 with a play is formed thereon. Moreover, the locking plate 9 is configured to close the accommodating chamber for the refill S for staples from the rear by guiding the lower side edge 60 of the locking plate 9 while the edge 60 is sliding on the inner surface of the guide piece 36 in the refill body 2, and, at the same time, by guiding the lower side edge 61 of the locking plate 9 while the edge 61 is sliding on the inner surface of the guide piece 37 in the refill body 2.

The flexible piece 65 elastically deformed by forming slots 62 and 63 is provided on the locking plate 9. The locking section (locking hole) 66 is formed on the flexible piece 65. An engaging projection 67 engaged with the concave portion 13 formed on the bottom wall 3 at the rear end of the refill body 2 is formed on the lower end of the locking plate 9, and an engaging projection 68 engaged with the concave portion 15 formed on the bottom wall 3 at the rear end of the refill body 2 is formed on the lower end of the locking plate 9. A resting projection 64 extending from the upper end to the engaging projection 67 is provided on the inner surface of the locking plate 9, and a resting projection 69 extending from the upper end to the engaging projection 68 is provided on the inner surface of the locking plate 9.

The pressing member 70 comprises: a pressing plate 71; a reinforcing wall 72 provided on the left side of the pressing plate 71, and a reinforcing wall 73 provided on the right side of the pressing plate 71; and the guide shaft 75 provided in such a way that one end of the shaft 75 is protruding from the left reinforcing wall 72, and the other end is protruding from the right reinforcing wall 73. Both sides of the guide shaft 75 are configured to be guided in the guide slot 20 of the right wall 6 and the guide slot 21 of the left wall 7. A locking piece 76 is provided at both sides of the guide shaft 75, prevents the pressing member 70 from moving upward and allows the member 70 to move downward as the pieces 76 are locked by the small projection 26 formed on the guide slot 20, and by the small projection 27 formed on the guide slot 21.

Moreover, a control shaft 77, by which one end of the control shaft 77 slides on the inner surface of the right wall 6, the other end slides on the inner surface of the left wall 7, and the transverse movement of the pressing member 70 is controlled, is formed as one body for the guide shaft 75. Here, if indicating sections 20*a*, which indicates the number of the laminated sheet-type connected staples S, are formed on both sides of the guide slot 20, and indicating sections 21*a*, which indicates the number of the laminated sheet-type connected staples S, are formed on both sides of the guide slot 21, the number of the sheet-type connected staples S remaining in the refill body 2 can be visually checked in an easier manner by the position of the guide shaft 75 moving along the guide slots 20 and 21.

In the present embodiment, a line of flexure shown in the center of the end surface is an indicator for the above-described indicating section showing a remaining amount of the sheet-type connected staples S when edges in the lower portion of the end surface of the guide shaft 75 guided in the above-described guide slots 20 and 21 are chamfered. And a portion having signs of 5K, 4K, 3K, 2K, 1K, and the like shown in the drawings represents that the remaining amount is 5000 pieces, 4000 pieces, 3000 pieces, 2000 pieces, 1000 pieces, and the like. Furthermore, 500 means that the remaining amount is 500 pieces.

A notch 79 with a shape of substantially "U" is formed at substantially the center in the front end of the pressing plate 71, and locking shoulder sections 86 and 87 are formed in the front end of the plate 71 sandwiched between the sections 86 and 87. Furthermore, a guide projection 80 is formed by the locking shoulder section 86, and a guide projection 81 is formed by the locking shoulder section 87 on the pressing plate 71. Moreover, four pressing projections (pressing sections) 82 pressing the sheet-type connected staples S are provided on the pressing plate 71: that is, one pair of two pressing projections 82 on the lower surface at substantially the center of the plate 71, and each of another pair of two pressing projections 82 on the lower surface of the guide projections 80 and 81. An inclined side 83 inclined rearward is formed on the pressing projections 82 to prevent obstruction to delivery of the sheet-type connected staples S.

Here, projections for backward-motion prevention 85 may be continuously formed underneath the pressing plate 71 as shown in FIG. 8. The projection for backward-motion prevention 85 has a shape of a saw blade having a vertical side 85*a* and an inclined side 85*b*, and the vertical side 85*a* is forward of the inclined side 85*b* in the same manner as that of the projections for backward-motion prevention 18 and 19. Furthermore, the tops of the projections for backward-motion prevention 85 are continuously formed in such a way that the height of the tops is greater as the tops are located to the rear. In this case, it is preferable to form the top positions of the projections for backward-motion prevention 18, 19, which are arranged side by side with the projections 85, out of phase with those of the projections for backward-motion prevention 85.

The main body 101 of the stapler 100 is installed in a printing machine such as a copying machine. As shown in FIG. 9(A) through FIG. 9(F), a cartridge accommodation section 102 is formed, and the cartridge 105 is provided in the cartridge accommodation section 102 in such a way that the cartridge 105 can be pulled out from the section 102. Here, the cartridge 105 may be removed from the cartridge accommodation section 102. A locking concave section 103 is formed forward of the cartridge 105, and a locking pawl 104 is formed at the center in the rear portion of the cartridge 105.

Furthermore, a projection 109 resting on the resting member 47 of the covering member 45 provided on the front wall 5 of the refill 1 for staples is provided in the cartridge 105. A cover 113 is installed in the rear portion of the cartridge 105 through a link member 112. The cover 113 is installed in a reclosable manner, and is energized in the closing direction with an elastic member such as a spring. The above cover 113 has a function as a lid by which the accommodation section 102 in the stapler 100 is closed, and a function by which the cartridge 105 is unlocked, and a member as a knob which is held with fingers when the cartridge 105 is pulled out after the cartridge 105 is unlocked. The cartridge 105 has a configuration in which the cartridge 105 is fixed by being pushed into the cartridge accommodation section 102, fixing of the cartridge 105 is released by pulling the cover 113, and the cartridge 105 is pulled out in the direction in which the cartridge 105 is removed.

Moreover, when the cartridge 105 is pulled out, the energizing force of the above-described arm member 106 for the refill body 2 is also applied in the direction in which the cartridge 105 is pulled out. When the cover 113 is unlocked by the above application, the cartridge 105 is pushed out to automatically be located at a predetermined position.

A forming plate, by which the straight-type staples located at the tip of the sheet-type connected staples S are formed in a "U" shape, and a driver, by which the staples deformed in a "U" shape are pushed out, arranged in the front portion of the cartridge accommodation section 102 in the stapler body 101. A sending pawl, by which the sheet-type connected staple S at the lowest layer is intermittently sent out to the side of the driver, is provided in the lower portion of the cartridge accommodation section 102.

When a plurality of sheets of paper are filed in the above-described configuration, the stapler body 1 has a configuration in which a sheet-type connected staple is sent forward with the sending pawl, a staple located at the tip is bent into a U-shaped one, the above-described sheets of paper are stapled with the above bent staple, using the driver, and the tip of the staple is bent for filing after the above stapling to complete processing.

The energizing unit by which the pressing member 70 of the refill 1 for staples is energized in the pressing direction is provided in the stapler body 101. The above energizing unit is pivoted in the upper portion, and comprises: the arm member 106 the lower portion of which can be rotated and the elastic member by which the arm member 106 is energized downward. The lower portion of the arm member 106 is configured to have downward inclination toward forward, and the members 106 are provided on both sides of the cartridge accommodation section 102. Here, the energizing unit may have a configuration in which the pressing member 70 is directly energized.

Subsequently, a state in which the refill 1 for staples and the stapler 100 are used will be explained. As shown in FIG. 13(A) through FIG. 13(C), the sheet-type connected staples S are laminated and held in the refill body 2 of the refill 1 for staples. The laminated sheet-type connected staples S are put on the upper surface 16 of the bottom wall 3, the fore-and-aft movement of the staples is controlled by the front wall 5 and the resting projections 64 and 69 of the locking plate 9, and the transverse movement of the staples is controlled by the right 6 and the left wall 7. The pressing projections 82 formed underneath the pressing member 70 rest on the sheet-type connected staple S at the uppermost layer. Here, with regard to the pressing member 70, the tips of the guide projections 80 and 81 also rest on the front wall 5, and the rear portion 74 rests on the resting projections 64 and 69 of the locking plate 9. According to the above-described configuration, the sheet-type connected staples S are held in the refill 1 for staples.

The above-described refill 1 for staples is mounted on the cartridge 105 in the stapler 100. When the refill 1 for staples is mounted on the above cartridge 105, the locking sections 48 and 49 provided at the tip of the refill body 2 are engaged with the locking concave section in the cartridge 105, and the locking hole 66 in the rear portion in the refill body 2 is engaged with the locking pawl 104 in the cartridge 105. When the locking sections 48 and 49 in the refill body 2 are engaged with the locking concave section 103, the resting member 47 of the covering member 45 rests on the projection 109 to rotate the covering member 45 upward around the connecting section 46 for opening the delivery port 41. That is, the refill for staples is mounted into the cartridge 105 to open the delivery port 41, and the accommodated sheet-type connected staples S can be delivered by opening the above delivery port 41. Here, when the resting member 47*a* rests on the projection 109, the covering member 45*a* is rotated around the connecting section 46*a* in the direction toward the thin-wall (the X direction in FIG. 14(E)) to move the projected portion 44*b* upward for opening the delivery port 41.

When the refill body 2 is pressed to the side of the cartridge 105 in a state in which the above-described locking sections 48 and 49 are locked, the flexible piece 65 in the rear portion rests on the locking pawl 104, the piece 65 is bent inward, and the flexible piece 65 recovers the original state after the locking hole 66 formed on the flexible piece 65 is engaged with the locking pawl 104. As described above, the pressing member 70 locks the locking plate 9 against rotation because the rear portion 74 is engaged with the resting projections 64 and 69 in the locking plate 9, and the front ends of the guide projections 80 and 81 rest on the front wall 5. Accordingly, rotation of the locking plate 9 itself is limited, but the flexible piece 65 between the resting projections 64 and 69 can be elastically deformed by the provided slots 62 and 63, and the piece 65 can be bent inward by the height of the resting projections 64 and 69, that is, until the piece 65 rests on the sheet-type connected staples S.

As described above, the refill 1 for staples which has been mounted in the cartridge 105 is configured not to be separated from the cartridge 105 until rotation of the locking plate 9 disengages the locking pawl 104 from the locking hole 66. Moreover, as the locking plate 9 can not be rotated until all the accommodated sheet-type connected staples S are delivered, the refill 1 for staples is configured not to be separated from the cartridge 105 until all the sheet-type connected staples S are delivered.

When the cartridge 105 mounted in the refill 1 for staples is pushed into the stapler body 101, the arm members 106 and 106 provided on both sides of the cartridge accommodation section 102 are engaged with the both ends of the guide shaft 75 in the pressing member 70, and the arm members 106 and 106 are pushed upward against the elasticity of the elastic member (not shown). Accordingly, the pressing member 70 is pushed downward by the arm members 106 and 106 which are energized downward by the elastic member, and the above-described pressing projections 82 press the laminated sheet-type connected staples S. When the cartridge 105 is completely held in the stapler body 101, the cover 113 is automatically closed with the elastic member.

When the stapler 100 is driven, the sending pawl (not shown) intermittently sends out the sheet-type connected staple S at the lowest layer from the delivery port 41 to the side of the driver, one straight-type staple located at the front end of the sent-out sheet-type connected staple S is deformed in a "U" shape by the forming plate, the deformed staple is pushed out by the driver to file the sheets of paper.

Thus, the sheet-type connected staples S are sent out one by one. The refill 1 for staples can be removed after the cartridge 105 is pulled out from the stapler main body 101 under a state in which the cover 113 is held. However, the refill 1 for staples is configured not to be removed from the cartridge 105 when there is remained a sheet-type connected staple S in the refill body 2 as described above. That is, the pressing member 70 can not be moved forward as the front ends of the guide projections 80 and 81 rest on the inner surface of the front wall 5. As the resting projections 64 and 69 rest on the rear portion 74 of the pressing member 70, rotation of the locking plate 9 is limited, and the plate 9 can not be rotated in the direction in which the locking pawl 104 is disengaged from (gets out of) the locking hole 66, that is, in the inner (unlocking) direction. For example, as shown in FIG. 13(B), the refill 1 for staples can not be removed from the cartridge 105 while the last one sheet of paper is being sent out.

As shown in FIG. 13(C), the pressing projections 82 fall into the look-through hole 11 or the notch 12, and the pressing plate 71 rests on the bottom wall 3 in the pressing member 70 when all the sheet-type connected staples S are delivered from the refill body 2. When the pressing plate 71 in the above-described pressing member 70 falls until the plate 71 rests on the bottom wall 3, the guide projections 80 and 81 formed in the front ends of the pressing projections 82 get out of and rest on the inner surface of the front wall 5, and the pressing member 70 can emerge or submerge trough the delivery port 41. The pressing member 70 can move forward until the locking shoulder sections 86 and 87 rest on the inner surface of the front wall 5. When the pressing member 70 can be moved forward, the locking plate 9 can be rotated in the inner direction while pushing out the pressing member 70 forward. As the locking pawl 104 can be disengaged from the locking hole 66 when the locking plate 9 is rotated by holding the tip of the cover plate 51 with fingers, the refill 1 for staples can be removed from the cartridge 105.

Moreover, when the sheet-type connected staples S are accommodated, the pressing member 70 can not be moved forward because both ends of the guide shaft 75 are guided in the guide slots 20 and 21. As the resting projections 64 and 69 rest on the rear portion of the pressing member 70, the locking plate 9 is locked as described above, and can not be rotated in the direction in which the locking pawl 104 is disengaged from the locking hole 66 in the direction in which the locking pawl 104 is disengaged from (gets out of) the locking hole 66, that is, in the inner direction (unlocking direction). For example, as shown in FIG. 13(B), the refill 1 for staples can not be removed from the cartridge 105 while the last one sheet of paper is being sent out.

Moreover, when all the sheet-type connected staples S are delivered from the refill body 2, the pressing projections 82 fall into the look-through hole 11, or the notch 12, and the pressing plate 71 rests on the bottom wall 3 in the pressing member 70 as shown in FIG. 13(C). Thereby, one end of the guide shaft 75 gets out of the guide slot 20, and enters into the concave portion 22, and the other end gets out of the guide slot 21, and enters into the concave portion 23, the guide shaft 75 can move forward until one end of the guide shaft 75 is locked at the edge of the front end of the concave portion 22, and the other end of the guide shaft 75 is locked at the edge of the front end of the concave portion 23. Thereby, the locking plate 9 can be rotated in the inner direction while pushing out the pressing member 70 forward, the locking pawl 104 can be disengaged from (gets out of) the locking hole 66 when the locking plate 9 is rotated by holding the tip of the cover plate 51 with fingers, and the refill 1 for staples can be removed from the cartridge 105.

Thus, the configuration, in which the pressing member 70 can be moved in the unlocking direction (forward) for the first time when all the sheet-type connected staples S are delivered from the refill body 2, can be realized only by the above-described method using the guide projections 80 and 81, or only by a method using the guide shaft 75. Furthermore, a method combining both the two methods may be applied.

Here, as the refill 1 for staples is also energized in the direction in which the refill 1 is pulled out by the above-described arm members 106 and 106, the cartridge 105 is pushed out by the energizing force, and is easily pulled out when the cartridge 105 is pulled out from the staple main body 101.

Moreover, the projections for backward-motion prevention 18 and 19 are continuously formed on the bottom wall 3. The top of each of the projections for backward-motion prevention 18 and 19 is located between straight-type staples among the sheet-type connected staples S, or each of the projections for backward-motion prevention 18 and 19 rests on the rear end of the sheet-type connected staple S to prevent backward movement of the sheet-type connected staples S.

When the sheet-type connected staples S are sent out by the sending pawl of the stapler 100, the sheet-type connected staples S can be moved forward by climbing over the inclined sides 18*b* and 19*b*. And, when the sending pawl is returned, backward movement of the sheet-type connected staples S is prevented by a configuration in which the vertical sides 18*a* and 19*a* rest on a hollow portion or the rear end of the sheet-type connected staple S.

Moreover, downward inclination is formed toward the delivery port 41 as shown in FIG. 8 because the top portion of each of the vertical slides 18*a* and 19*a* is formed in such a way that the height of the top portion is greater as the top portion is located to the rear. Thereby, the front end of the sheet-type connected staple S can be securely and smoothly led to the delivery port 41 even when the sheet-type connected staples S are bent, for example, are bent backward. Moreover, the uppermost layer that is, the last sheet-type connected staple S is prevented from moving backward, and, at the same time, the sheet-type connected staples S can be securely sent by providing the projections for backward-motion prevention 85, which are similar to and are facing the projections 18 and 19, underneath the lower surface of the pressing member 70.

Moreover, the amount of backward movement of the sheet-type connected staples S can be reduced to equal to or less than half the pitch for the projections for backward-motion prevention 18, 19, and 85 by forming the top positions of the projections for backward-motion prevention 18, 19 out of phase with those of the projections for backward-motion prevention 85. Thereby, the backward movement can be more effectively prevented. Here, the above-described four kinds of projections formed by the above pitch may be set out of phase with one another, or the distances between each kind of projections may be assumed to be different from one another. In these cases, the amount of the backward movement of the sheet-type connected staples S can be made to equal to or less than about a quarter of the distance between projections.

As described above, the laminated sheet-type connected staples S are pressed by the pressing member 70 energized by the arm members 106 and 106 as an energizing unit, and the sheet-type connected staple at the lowest layer is pressed against the bottom wall 3. As the sheet-type connected staple S at the lowest layer is pressed against the bottom wall 3 in the strongest way, the rear end is securely caught by the projections for backward-motion prevention 18 and 19. Furthermore, the backward movement is prevented because each staple is engaged with each concave portion between staples in the sheet-type connected staples S in the subsequent layer. As the sheet-type connected staple S at the uppermost layer has smaller energizing force of the energizing unit than that of the sheet-type connected staple S at the lowest layer, the staple at the uppermost layer is a little weakly pressed against the bottom wall 3, and is more easily returned than the staple at the lowest layer because there is no sheet-type connected staple S in the subsequent layer. But, as there are provided the projections for backward-motion prevention 85 on the pressing surface of the pressing member 70, even the sheet-type connected staple S at the uppermost layer can be prevented in almost the same manner as that of the staple at the lowest layer from moving backward.

As described above, the staple refill 1 can be mounted in the cartridge 105 for staplers 100 only by pushing the refill 1 into the cartridge 105, and can be separated from the cartridge 105 after the locking plate 9 is rotated only by pulling the cover plate 51. Accordingly, it is extremely convenient that mounting and dismounting of the refill 1 for staples can be performed only with a single hand. Here, the staple refill 1 has been configured to be installed in the cartridge 105 of the stapler body 101 in a detachable manner according to the above-described embodiment. But, the refill 1 may be configured to be installed in the stapler body 101 in a detachable manner.

Here, the refill 1 for staples according to the embodiment is configured not to be removed from the cartridge 105 when there is remained a sheet-type connected staple S in the refill 1. But the cartridge 105 may be configured to be removed from the staple 100 even when there is remained a sheet-type connected staple S in the staple refill 1. The reason is that, for example, when a staple is clogged in the driver portion, the clogged staple is configured to be removed. Though the refill 1 for staples which can laminate and accommodate the sheet-type connected staples S has been explained in the above-described embodiment, the refill 1*a* for staples may be configured to accommodate rolled-sheet-type connected staples as shown in FIG. 15(A) through FIG. 15(H). This refill 1*a* for staples is configured to be installed in a stapler body, or a cartridge provided in the stapler body, and includes a cylindrical refill body 2*a* which holds the rolled-sheet-type connected staples.

A delivery path 10*a* is formed in the refill body 2*a*, a delivery port 41*a* which delivers the rolled-sheet-type connected staples, and a covering member 45*b* which closes the delivery port 41*a* is provided at the tip of the delivery path 10*a*. The covering member 45*b* is configured to open the delivery port 41*a* by engagement with the stapler body or one side of the cartridge when the refill body 2*a* is mounted in the stapler body or the cartridge. Here, a reference numeral 47*b* represents a resting member which opens the covering member 45*b* by resting on the stapler body, or the one side of the cartridge when the refill body 2*a* is mounted in the stapler body or the cartridge. Moreover, a projection for backward-motion prevention 17, which prevents the rolled-sheet-type connected staples from moving to a direction opposite to the delivery port 41*a*, is formed in the refill body 2*a*. Though the projection for backward-motion prevention 17 is provided at the lower side of the delivery path 10*a*, the projection 17 may be provided at the upper side, or at both the lower side and the upper side.

Second Embodiment

Figure 16:
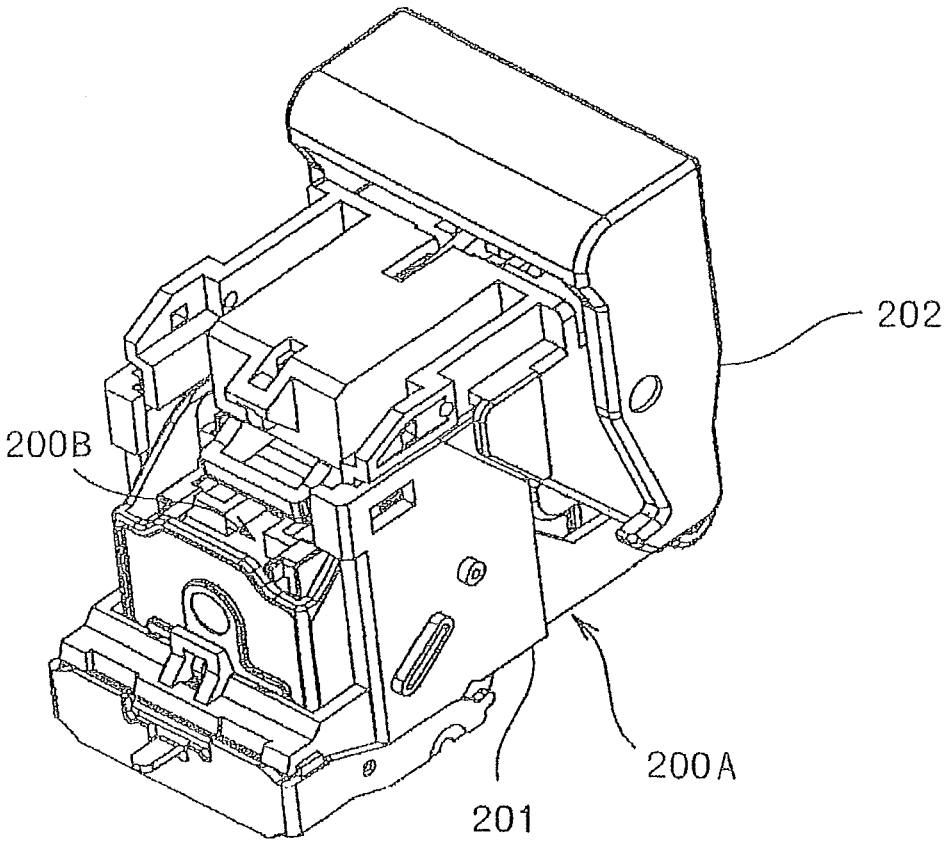
FIG. 16 is a perspective view of a cartridge according to the present invention.

FIG. 16 is a perspective view of a cartridge for staple sheets according to the present invention, and a reference numeral 200A represents the cartridge, and a reference numeral 200B represents a refill case in the drawing. The cartridge 200A comprises: a cartridge body 201; and a refill holder 202. The refill case 200B has the same configuration as that of the above-described refill 1 for staples.

Figure 17:
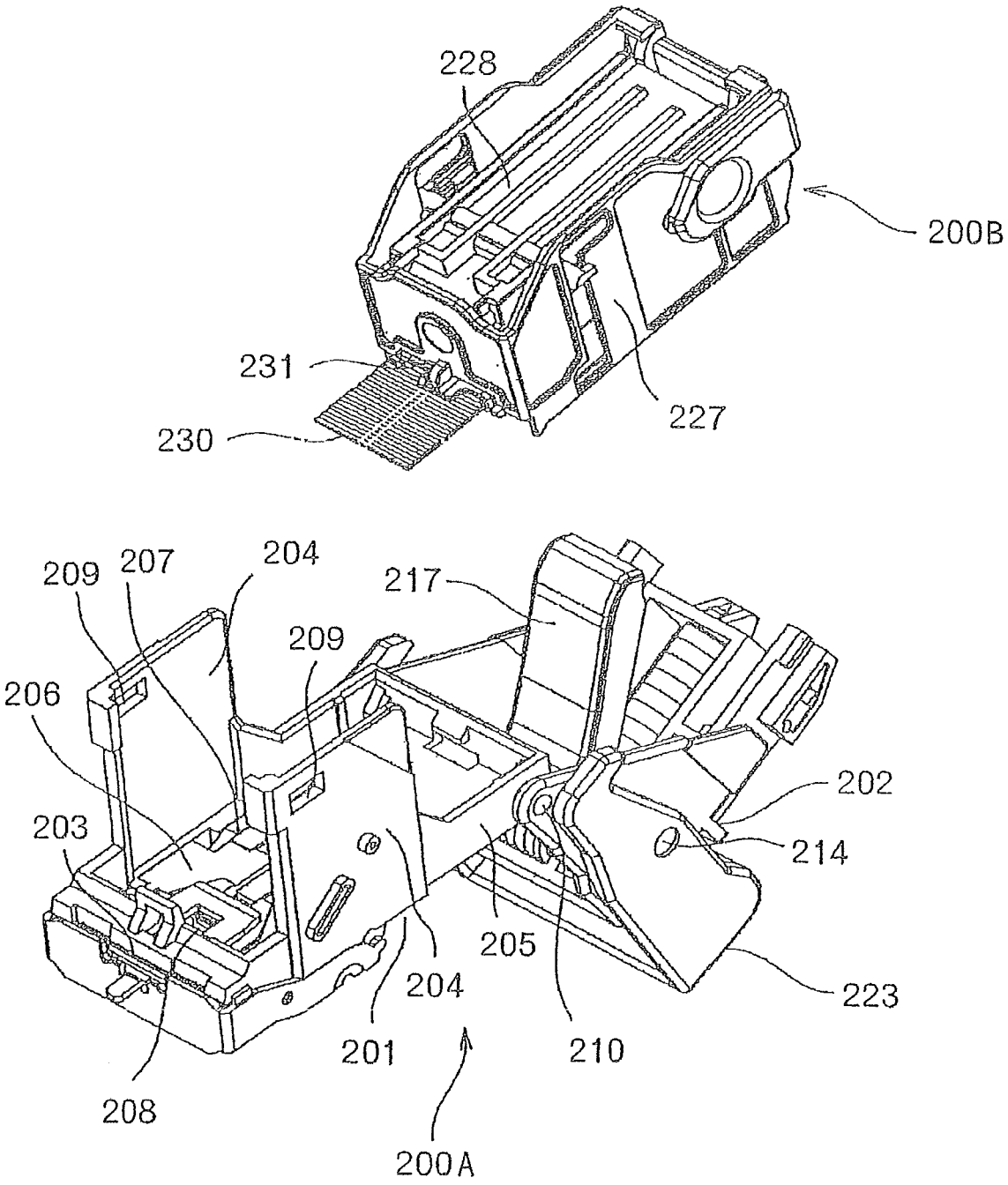
FIG. 17 is a perspective view showing a state in which the cartridge shown in FIG. 16 is opened, and a refill case together.
Figure 18:
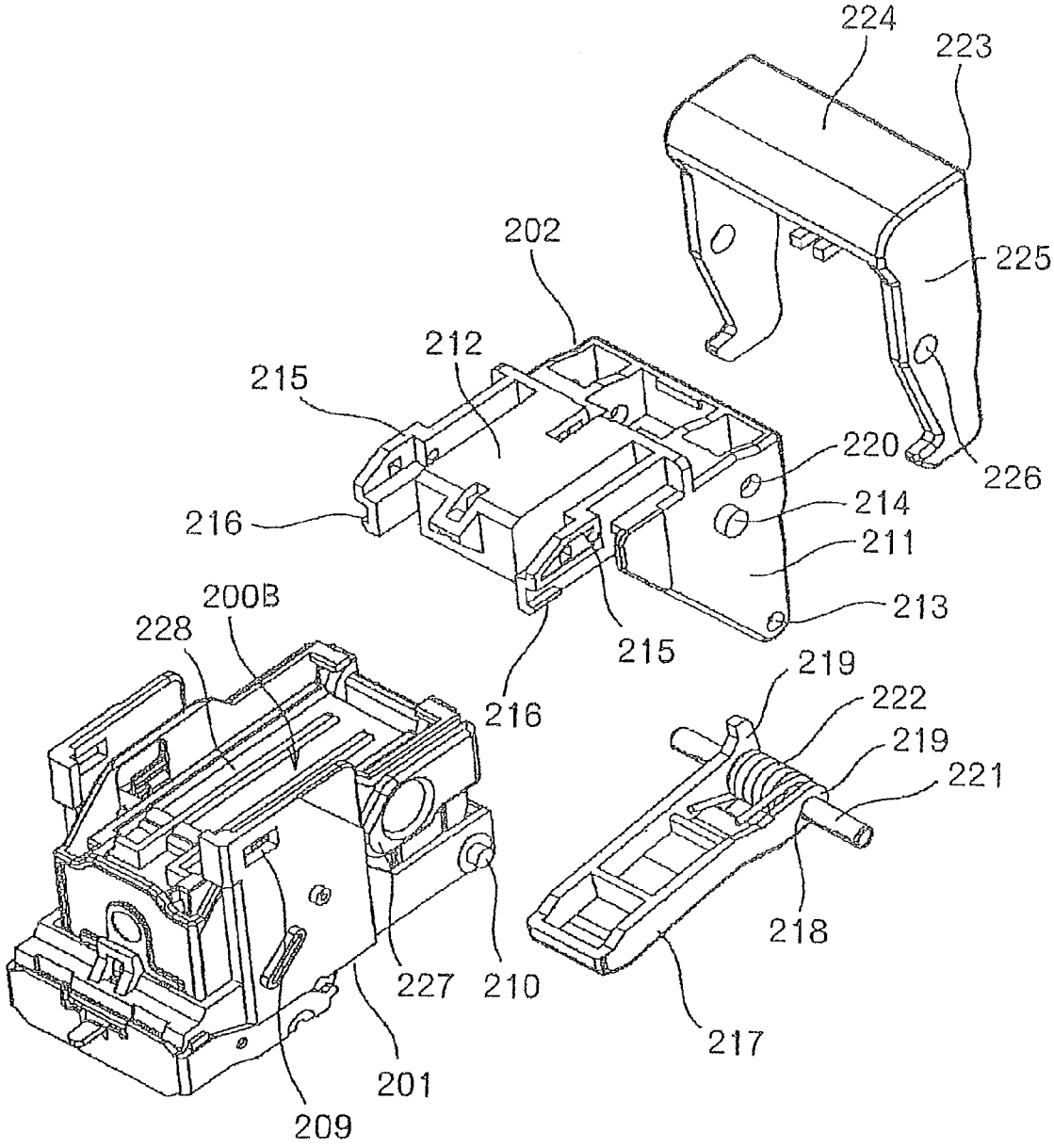
FIG. 18 is an exploded perspective view of the cartridge shown in FIG. 16.

The cartridge body 201 is provided with a forming and driving section 203 in the front portion as shown in FIG. 17 and FIG. 18, and, at the same time, with a holding section 207 holding the refill case 200B in a space defined by both right and left side plates 204, a frame plate 205, and a bottom portion 206 in a detachable manner. An opening section 208 receiving a sending unit (not shown) of staple sheets (sheet-type connected staple) is formed on the bottom portion. Moreover, a locking hole 209 is formed in the upper portion of the side plate 204. Furthermore, a protruding shaft 210 is formed on each of the right and left outside surfaces in the rear portion of the frame plate 205.

In the refill holder 202, a covering member 212 connects the upper areas of right and left side-piece portions 211 with a shape of a triangle, a bearing hole 213 is formed in a vertical-angle portion opposing to the upper area, and a protruding shaft 214 is formed at a center near the upper area. Arm pieces 215 are formed on each of the outside the covering member 212, respectively, and a locking hook 216 is formed in the lower portion of the tip of the arm piece 215 so as to protrude outward. Here, a engaging section which is engaged with the back surface of the refill case 200B set in the above-described holding section 207 is formed (not shown) in the rear portion of the upper surface.

Moreover, a staple push lever 217 the whole of which is formed like a tongue is arranged as a pressing unit (energizing unit) at the inside of the refill holder 202. The staple push lever 217 is formed slightly wide, and two protruding pieces 219 having a shaft hole 218 is formed in the base portion.

On the side piece portions 211 on both sides of the refill holder 202, a pin 221 is supported and fixed in shaft holes 220 provided in the vicinity of the above-described protruding shafts 214, and the pin 221, with a torsion spring 222, is rotatably engaged with a shaft hole 218 of a staple push lever 217. One end of the torsion spring 222 is engaged with the rear wall of the refill holder 202, and the other end is engaged with the inside surface of the staple push lever 217. Thereby, the staple push lever 217 is energized so that the lever 217 is always rotated in the direction (downward) opposing to a direction to the above-described covering member 212 by the above-described torsion spring 222.

A control lever 223 is swingablly installed in the refill holder 202. In the control lever 223, leg pieces 225, which are parallel to each other, are formed so as to protrude from each of both ends of a top plate 224, and each bearing hole 226 is formed in the middle portion of the leg piece 225. The bearing hole 226 of the leg piece 225 in the control lever 223 supports the protruding shaft 214 on the side piece portion 211 in the refill holder 202. Thereby, the control lever 223 is configured to swing around the above-described protruding shaft 214.

Moreover, each of the protruding shafts 210 formed on each of the outside surface in the rear portion of the frame plate 205 in the cartridge body 201 is rotatably supported in the corresponding bearing hole 213 in the vertical angle portion of the refill holder 202. Thereby, the refill holder 202 can be rotated to the cartridge body 201.

Then, the refill case 200B comprises: a main body (refill body) 227 which is of a box shape and is open in the upper portion; and a cover plate (pressing member) 228 arranged on the main body 227. Here, an open portion 229 (refer to FIG. 20) is formed on a part of the bottom portion of the main body 227. Staple sheets (sheet-type connected staples) 230 (refer to FIG. 20) are laminated and held in the refill case 200B. The staple sheet 230 is obtained by connecting straight staple needles in a sheet-like manner. Moreover, a delivery port 231 delivering the staple sheet 230 at the lowest layer is formed at the lower end of the front wall of the main body 227 in the refill case 200B, and the staple sheets 230 are configured to be delivered from the delivery port 231 one by one in FIG. 17. Here, the cover plate 228 is arranged in such a way that the plate 228 approaches the bottom portion as the staple sheets 230 held inside are delivered one by one, that is, are consumed.

Figure 19:
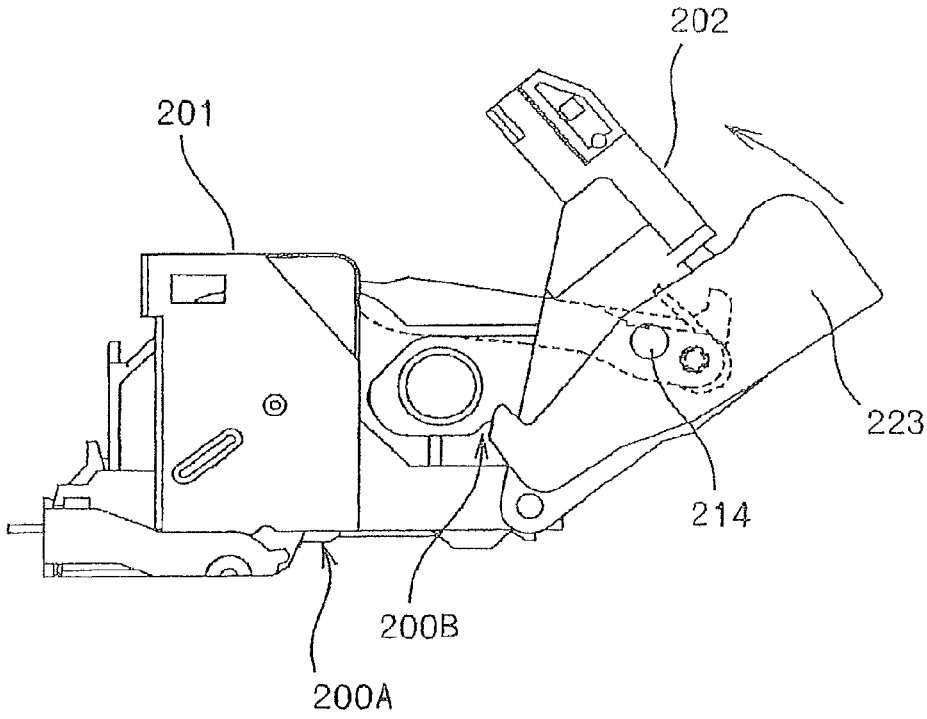
FIG. 19(A) is a side view showing a state during mounting operation of a refill case.
FIG. 19(B) is a side view showing a state after the mounting operation of the refill case.
Figure 19:
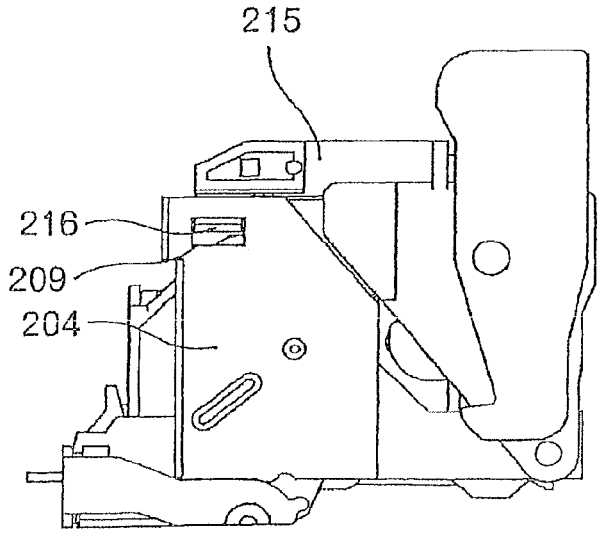
Figure 20:
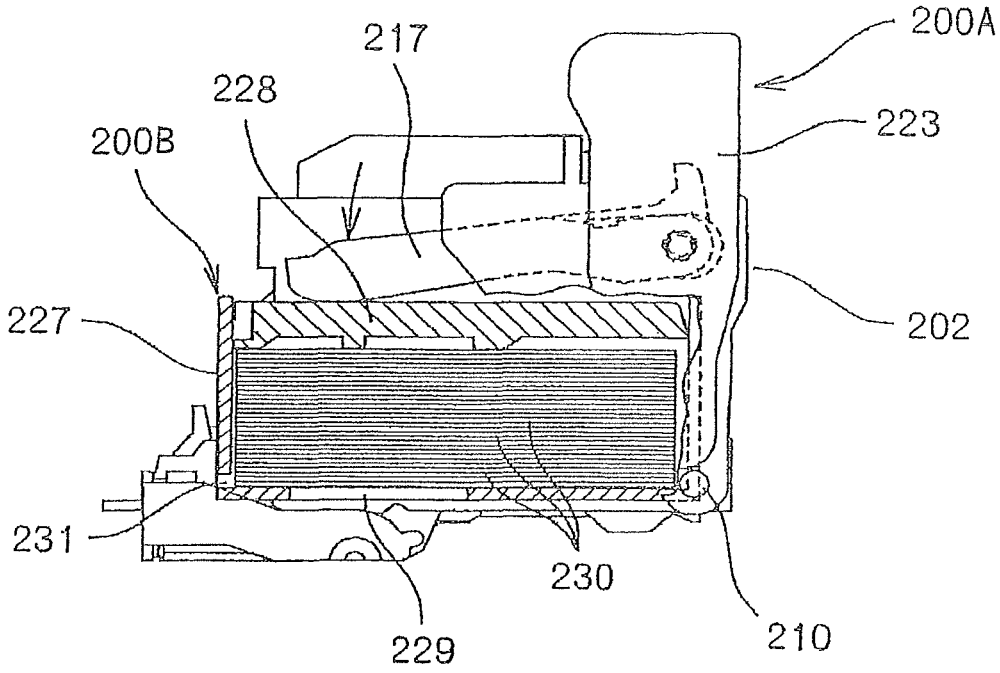
FIG. 20 is a side view with a partial sectional view of a cartridge.

Then, a use mode of the cartridge 200A for staple sheets according to the above-described configuration will be explained. In the first place, the control lever 223 is rotated to open the holding section 207 of the cartridge body 201 wide (FIG. 17 and FIG. 19(A)). Subsequently, the refill case 200B loading the staple sheets 230 inside is put into the holding section 207 from above at an angle for setting (refer to FIG. 18). Then, the control lever 223 is rotated in such a way that the refill holder 202, and, at the same time, the covering member 212 cover the refill case 200B. Subsequently, when the refill holder 202 is rotated to a limit for the rotation, the lower surface of the arm piece 215 is engaged with the upper surface of both side plates 204 in the cartridge body 201 as shown in FIG. 19(A) and FIG. 19(B), and, at the same time, the locking hook 216 is engaged with the locking hole 209 in the side plate 204 (refer to FIG. 22). At the same time, the engaging section located in the rear portion of the refill holder 202 pushes the rear surface of the refill case 200B forward, and the push lever 217 presses the upper surface of the cover plate 228, as shown in FIG. 20. Thereby, the refill case 200B is fixed in the cartridge body 201.

Here, an opening 208 is formed on the bottom of the cartridge body 201, and the above opening 208 has a configuration in which, when the refill case 200B is adequately set in the cartridge body 201, both the opening 208 and the opening 229 on the bottom of the cartridge body 201 form one opening. By the above configuration, the sending unit provided in the stapler body enters through the two openings to be engaged with the lower surface of the staple sheet 230 at the lowest layer.

Incidentally, when the holding section 207 in the cartridge body 201 is opened, the staple push lever 217 provided in the refill holder 202 protrudes to the inside of the refill holder 202 as shown in FIG. 17. But, the staple push lever 217 does not cause a trouble by greatly rotating the refill holder 202 when the staple push lever 217 mounts the refill case 200B. When the control lever 223 is rotated together with the refill holder 202 after setting the refill case 200B, the staple push lever 217 extends above the cover plate 228 of the refill case 200B. Subsequently, when the refill holder 202 is rotated to the limit for rotation, the staple push lever 217 presses the cover plate 228 of the refill case 200B downward through the spring force of the torsion spring 220.

Thus, as the refill case 200B is mounted in the cartridge body 201, the staple push lever 217 is interlockingly engaged with the front portion on the upper surface of the cover plate 228 in the refill case 200B to press the portion downward in the direction orthogonal to the upper surface. The cover plate 226 (pressing member) is configured to be energized in the pressing direction by the staple push lever (energizing unit) 217 provided in the cartridge 200A When the main body (refill body) 227 is installed in the cartridge 200A. That is, the staple push lever (energizing unit) 217, which energizes the cover plate (pressing member) 226 in the refill case (the refill for staples) 200B in the pressing direction when the refill case (refill for staples) 200B is installed, is provided in the cartridge 200A.

The sending unit is arranged downward from the engaging section of the staple push lever 217. Accordingly, as a friction resistance between the lower surface of the staple sheet 230 at the lowest layer and the sending unit is kept large by the pressing force of the staple push lever 217, the staple sheets 230 can be securely sent. Then, after the staple sheet 230 is sent to the forming and driving section 203, staple needles are sequentially formed into a U-shaped one from the first staple needle, and is driven out further downward.

The above driving operation of the staples is repeated, and, as the staple sheets 230 held inside are consumed, the staple sheet 230 at the uppermost layer gradually approaches the bottom. Even in this case, sending force by the sending unit is maintained enough because the staple push lever 217 presses the staple sheets 230 downward by spring force.

Figure 21:
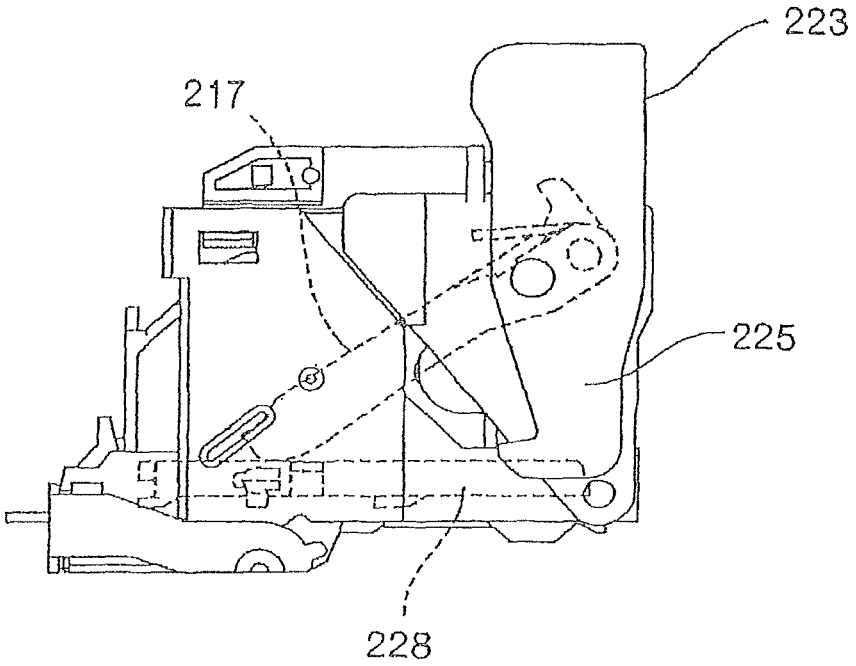
FIG. 21 is a side view of a cartridge in a state in which there is no staple sheet inside.
Figure 22:
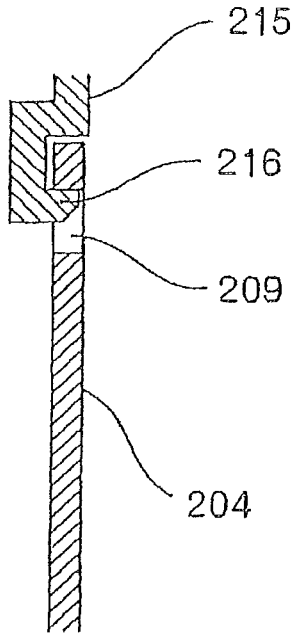
FIG. 22 is a sectional view showing a state in which a locking hook is locked in a locking hole.

Moreover, when there is remained no staple sheet 230 in the refill case 200B as shown in FIG. 21, the empty refill case 200B is required to be removed and to be exchanged for the new one. In this case, the engagement between the locking hook 216 in the refill holder 202 and the locking hole 209 on the side plate 204, which are shown in FIG. 22, is manually disengaged. As the holding section 207 is opened wide when the control lever 223 is rotated backward, the empty refill case 200B can be removed, and a new refill case 200B can be mounted. The removed empty refill case 200B may be discarded, or recycled for reuse.

As described above, the above-described cartridge for staple sheets has a configuration in which the pressing unit (energizing unit) 217 is provided in the side of the cartridge 200A. Accordingly, the pressing unit (energizing unit) 217 can be repeatedly used because there is no need to provide a pressing unit for the staple sheets 230 held inside in the refill case 200B itself.

As there is no need to provide the pressing unit (energizing unit) 217 for the staple sheets 230 held inside in the refill case 200B itself, it is possible to efficiently use materials without wasting them.

Though the pressing unit (energizing unit) 217 is configured to be provided in the side of the cartridge 200A, there is no trouble when the refill case 200B is mounted or removed because the unit 217 is provided in the refill holder 202 which is rotated to the cartridge body 201.

Handling is very easy because one-touch operation can be realized by the configuration in which operation of the refill holder 202 for holding the refill case 200B is completed, and, at the same time, the pressing unit (energizing unit) presses the staple sheets 230.

Moreover, troublesome operations such as removing of parts are required in the case of a configuration in which the pressing unit is provided in a stapler when the pressing function of the pressing unit is deteriorated, and the pressing unit is required to be removed. But operations for exchanging the pressing unit is not specially required according to the present invention in which the pressing unit is provided in the cartridge mounted in a stapler body in a detachable manner, and the pressing unit is simultaneously exchanged when the cartridge is exchanged.

Here, there is required only a configuration in which a pressing unit is provided in a refill holder, and the present invention is not limited to the configurations shown in the drawings. There may be applied, for example, a configuration in which a staple push lever 217 (energizing unit) is formed like the arm member 106 shown in FIG. 9(A) through FIG. 9(F), the lever 217 is engaged with both ends of the guide shaft 75, the guide shaft 75 is energized by an energizing unit, and the cover plate (pressing member) 226 is energized in the pressing direction (in which the staple sheets 230 are laminated). That is, there may be applied a configuration in which, when the main body (refill body) 227 is installed in the cartridge 200A, the guide shaft 75 is engaged with the staple push lever 217 (energizing unit) provided in the cartridge 200A, and the cover plate (pressing member) 226 is energized by an energizing unit in the pressing direction (in which the staple sheets 230 are laminated).

DESCRIPTION OF REFERENCE NUMERALS

S sheet-type connected staples
1 refill for staples
1*a* refill for staples
2 refill body
2*a* refill body
3 bottom wall
5 front wall
5*a* projection
6 right wall
7 left wall
9 locking plate
10*a* delivery path
11 look-through hole
12 notch
13 concave portion
15 concave portion
16 upper surface
17 projection for backward-motion prevention
18 projection for backward-motion prevention
18*a* vertical side
18*b* inclined side
19 projection for backward-motion prevention
19*a* vertical side
19*b* inclined side
20 guide slot
20*a* indicating section
21 guide slot
21*a* indicating section
22 concave portion
23 concave portion
24 concave portion
25 concave portion
26 small projection
27 small projection
29 notch
30 notch
31 bearing piece
32 bearing piece
33 bearing hole
34 bearing hole
36 guide piece
37 guide piece
39 engaging projection
40 engaging projection
41 delivery port
41*a* delivery port
42 slot
43 slot
44*a* base portion
44*b* projected portion
45 covering member
45*a* covering member
45*b* covering member (delivery control unit)
46 connecting section
46*a* connecting section
46*b* concave portion
47 resting member
47*a* resting member
47*b* resting member
48 locking section
49 locking section
51 cover plate
52 bearing plate
53 bearing plate
55 rod
56 engaging concave section portion
57 long hole
58 long hole
60 side edge
61 side edge
62 slot
63 slot
64 resting projection
65 flexible piece
66 locking hole (locking section)
67 engaging projection
68 engaging projection
69 resting projection
70 pressing member
71 pressing plate
72 reinforcing wall
73 reinforcing wall
74 rear portion
75 guide shaft
76 locking piece
77 control shaft
79 notch
80 guide projection
81 guide projection
82 pressing projection (pressing section)
83 inclined side
85 projection for backward-motion prevention
85*a* vertical side
85*b* inclined side
86 locking shoulder section
87 locking shoulder section
100 stapler
101 stapler body
102 cartridge accommodation section
103 locking concave section
104 locking pawl (locked section)
105 cartridge
106 arm member
109 projection (one side)
112 link member
113 cover
200A cartridge (cartridge for staple sheets)
200B refill case (refill for staple)
201 cartridge body
202 refill holder
203 forming and driving section
204 side plate
205 frame plate
206 bottom portion
207 holding section
208 opening section
209 locking hole
210 protruding shaft
211 side-piece portion with a shape of a triangle
212 covering member
213 bearing hole

214 protruding shaft
215 arm piece
216 locking hook
217 staple push lever (pressing unit)
218 shaft hole
219 protruding piece
220 shaft hole
221 pin
222 torsion spring
223 control lever
224 top plate
225 leg piece
226 bearing hole
227 main body (refill body)
228 cover plate (pressing member)
229 open portion
230 staple sheets (sheet-type connected staples)
231 delivery port

INDUSTRIAL APPLICABILITY

The present invention can be applicable for an electric stapler used in a copying machine and the like.

What is claimed is:

1. A staple refill comprising:

a refill body accommodating sheet-type connected staples, the refill body including a bottom wall, a right wall provided on a right side of the bottom wall and formed with a vertically extending right guide slot, and a left wall provided on a left side of the bottom wall and formed with a vertically extending left guide slot; and a pressing member provided in the refill body in a movable manner to press the sheet-type connected staples, the pressing member including a guide shaft guided along the right and left guide slots, wherein the guide shaft includes a right end portion protruding outside the right wall through the right guide slot, and a left end portion protruding outside the left wall through the left guide slot.

2. The staple refill according to claim 1, wherein a bottom side of each of the right and left end portions of the guide shaft is chamfered.

3. The staple refill according to claim 1, wherein each of the right and left end portions of the guide shaft includes an extension extending along an outer surface of a corresponding one of the right and left walls of the refill body.

4. The staple refill according to claim 1, wherein each of the right and left guide slots includes a concave portion extending rearward at an upper end of the guide slot.

5. The staple refill according to claim 1, wherein the refill body further includes a front wall provided on front sides of the right and left walls, and wherein the pressing member further includes a guide projection at a front end of the pressing member, the guide projection being configured to contact an inner surface of the front wall.

6. The staple refill according to claim 1, wherein the refill body further includes a front wall provided on front sides of the right and left walls, and wherein the bottom wall, the right wall, the left wall, and the front wall of the refill body are formed as an integral one piece structure.

7. The staple refill according to claim 6, wherein the refill body is formed of synthetic resin.

8. The staple refill according to claim 1, wherein the refill body is formed of synthetic resin.

9. A staple refill comprising:

a refill body accommodating sheet-type connected staples, the refill body including a bottom wall, a right wall provided on a right side of the bottom wall and formed with a vertically extending right guide slot, and a left wall provided on a left side of the bottom wall and formed with a vertically extending left guide slot, the sheet-type connected staples being directly contained by the bottom wall, the right wall, and the left wall of the refill body; and a pressing member provided in the refill body in a movable manner to press the sheet-type connected staples, the pressing member including a guide shaft guided along the right and left guide slots, wherein the guide shaft includes a right end portion protruding outside the right wall through the right guide slot, and a left end portion protruding outside the left wall through the left guide slot.

* * * * *